US006811941B2

(12) United States Patent
Horiuchi et al.

(10) Patent No.: US 6,811,941 B2
(45) Date of Patent: Nov. 2, 2004

(54) ELECTROSTATIC IMAGE DEVELOPING TONER AND IMAGE FORMING METHOD

(75) Inventors: Kazuhisa Horiuchi, Hachioji (JP); Tatsuya Nagase, Tachikawa (JP); Meizo Shirose, Hachioji (JP); Hiroshi Yamazaki, Hachioji (JP); Hiroyuki Yamada, Tsukui-machi (JP); Ken Ohmura, Hachioji (JP); Asao Matsushima, Hino (JP); Shiro Hirano, Hachioji (JP); Yoshiki Nishimori, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/201,403

(22) Filed: Jul. 22, 2002

(65) Prior Publication Data

US 2003/0027072 A1 Feb. 6, 2003

Related U.S. Application Data

(63) Continuation-in-part of application No. 10/011,634, filed on Nov. 6, 2001.

(30) Foreign Application Priority Data

Nov. 7, 2000 (JP) ..... 2000-338881
Mar. 21, 2001 (JP) ..... 2001-079671

(51) Int. Cl.[7] ..... G03G 9/08
(52) U.S. Cl. ..... 430/110.1; 110/137.14
(58) Field of Search ..... 430/110.1, 110.3, 430/137.14

(56) References Cited

U.S. PATENT DOCUMENTS

2001/0031412 A1 * 10/2001 Itami et al. ..... 430/58.15
2002/0012863 A1 * 1/2002 Akai et al. ..... 430/110.1
2002/0037469 A1 * 3/2002 Kohyama et al. ..... 430/110.3
2003/0049554 A1 * 3/2003 Ohmura et al. ..... 430/110.2

FOREIGN PATENT DOCUMENTS

JP 11338192 * 12/1999

* cited by examiner

*Primary Examiner*—John L Goodrow
(74) *Attorney, Agent, or Firm*—Squire, Sanders & Dempsey

(57) ABSTRACT

Disclosed is an electrostatic image developing toner comprising a coloring agent and toner particles, said toner particles have a matrix-domain structure, and the average of the area of a Voronoi polygon formed by the perpendicular bisecting line between the centers of gravity of domains adjacent to each other in said matrix-domain structure is from 20,000 to 120,000 $nm^2$, and the variation coefficient of the area of said Voronoi polygon is less than or equal to 25 percent.

Color image having, particularly good transparency and excellent color difference, can be obtained by the toner which is not affected by a residual material present on the surface of toner particles and does not result in variation of the amount of static charge at high temperature as well as at high humidity or after long leaving without operation.

19 Claims, 8 Drawing Sheets

FIG. 6 ( a )
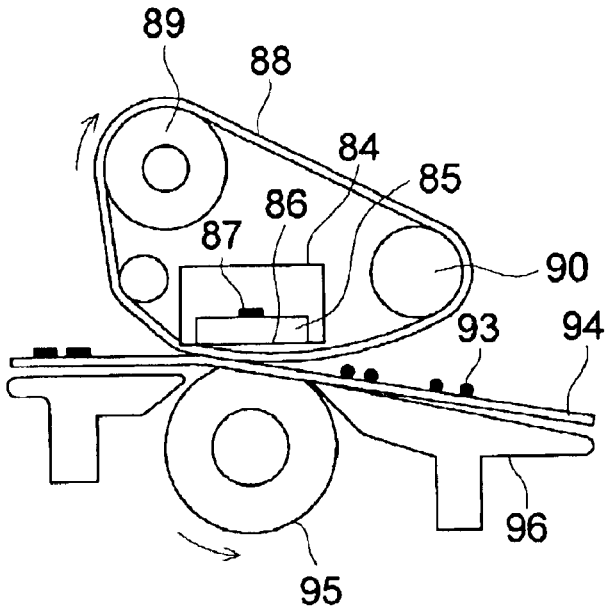
FIG. 6 ( b )
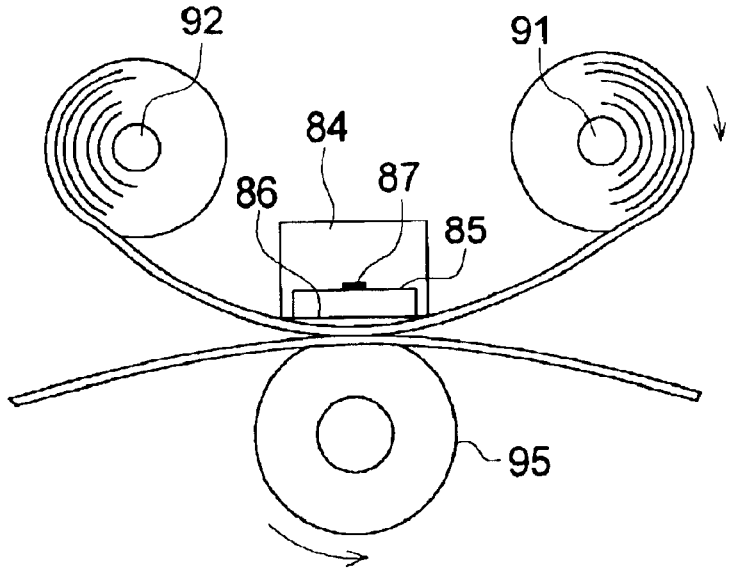

FIG. 8 ( a )
TONER HAVING NO CORNERS
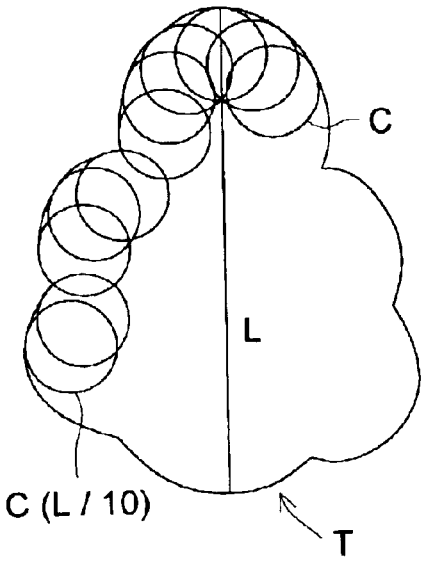
FIG. 8 ( b )
TONER HAVING CORNERS
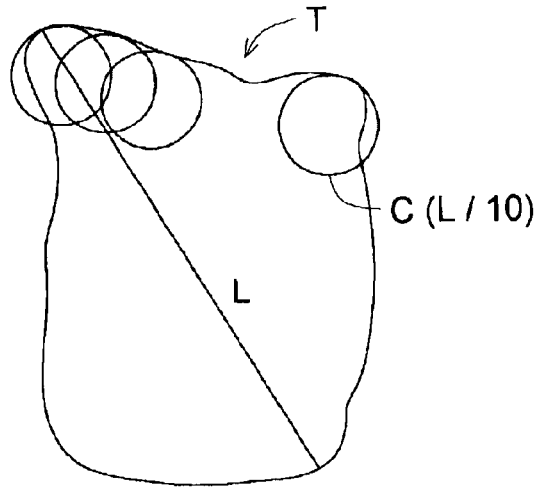
FIG. 8 ( c )
TONER HAVING CORNERS
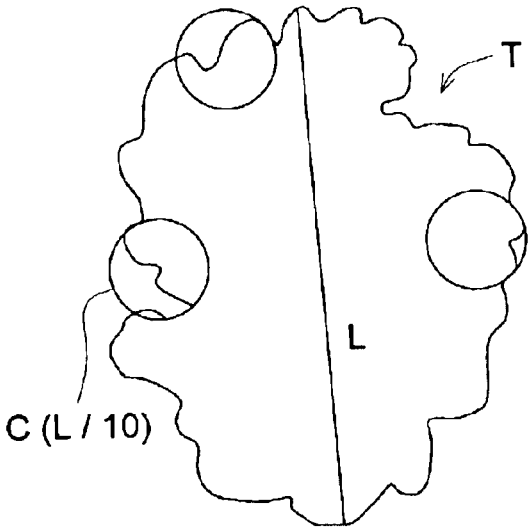

ELECTROSTATIC IMAGE DEVELOPING TONER AND IMAGE FORMING METHOD

This application is a continuation-in-part application of U.S. patent application Ser. No. 10/011,634 filed Nov. 6, 2001.

FIELD OF THE INVENTION

The present invention relates to an electrostatic image developing toner which is employed in copiers and printers, a production method of said toner, and an image forming method using said toner.

BACKGROUND OF THE INVENTION

Recently, Japanese Patent Publication Open to Public Inspection No. 2000-214629 disclosed that since it is possible to control the diameter as well as the shape of polymerization toner particles, prepared utilizing a suspension polymerization method or an emulsion polymerization method, during the polymerization process in a water based medium, it is possible to prepare minute spherical toner particles having no corners as well as having a narrow size distribution. Said toner has received attention as a toner which makes it possible to reproduce minute dot images for the use of digital images due to its fine line reproducibility as well as excellent definition.

It is known that the dispersibility of coloring agents, which are incorporated into said polymerization toner, is inferior to those of a pulverized toner. This is due to the following factors. In said suspension polymerization method, polymerization is carried out after dispersing pigments as the coloring agents into a monomer. As said polymerization proceeds, said coloring agents coagulate due to an increase in the viscosity of monomer droplets. Further, in said emulsion polymerization method, during polymerization, namely coagulation process, since the effects of the pH accelerate coagulation, said coloring agents coagulate.

As mentioned above, said polymerization toner exhibits problems such that dispersibility is degraded due to the occurrence of the coagulation of coloring agents during the production processes. Therefore, techniques to improve the dispersion of said coloring agents have been increasingly investigated, however a technique, which overcomes dispersion problems of said coloring agents, has not been found yet. In a multicolor image forming method, color images are formed by superimposing a plurality of toner images, whereby a certain degree of transparency is required. Therefore, when images are formed on film for overhead projectors, said problems become critical.

Further, in said polymerization toner, surface active agents, as dispersing agents, and the like, which are employed in production processes, remain on the surface of toner particles as the final product. As a result, these residual materials cause problems such that the charge holding function of toner varies and toner results in brittleness due to the fact that said residual particles absorb moisture from the ambient air; particularly at high temperature and high humidity, fogging occurs; and resolution is degraded due to dust formed by the destruction of toner during development as well as transfer.

Further, when at high temperature and high humidity, an image forming apparatus is not operated for an extended period of time, a state is formed in which a toner having a varied amount of static charge due to the absorption of moisture and a fresh toner are mixed. As a result, problems occur in which uneven density results on halftone images comprised of halftone dots, and in multicolor image formation, color difference is increased due to difference in developability between developers of each color, which are further affected by said coloring agents incorporated in the toner of said developers.

In order to overcome said problems with residual materials on the surface of toner particles, Japanese Patent Publication Open to Public Inspection No. 57-15085 discloses a technique to decrease the amount of impurities on the surface of toner particles to less than or equal to the specified amount by repeatedly washing the prepared toner. However, the process, which employs a large amount of water for said washing, is not preferred because said process makes the toner production processes more complicated, and in addition, new problems occur in regard to the environmental protection.

It is generally well known that the state of coloring agents incorporated in a toner particle affects the performance of the toner such as resolution. For example, Japanese Patent Publication Open to Public Inspection Nos. 2000-81735 and 2000-284540 disclose that excellent color reproduction as well as static charge stabilizing properties is obtained by improving the dispersibility of a coloring agent in a toner by specifying the ratio of the length to breadth of the particle of said coloring agent as well as the number average diameter of said coloring agent particles employed in a pulverized toner. However, said patents only specify the coloring agent prior to incorporation into toner particles and do not suggest the state of said coloring agent in the toner particle.

Further, when a coloring agent is uniformly dispersed in a toner particle without resulting in a phase separation structure such as a domain structure or a coagulation structure, the resultant transparency is superior, while the resultant static charge holding function tends to be degraded. On the other hand, when said coloring agent is dispersed so as to result in phase separation structure or coagulation, the resultant static charge holding function is excellent, while light transmission is degraded. Japanese Patent Publication Open to Public Inspection No. 5-88409 discloses a capsule toner in which a coloring agent is coagulated into one lump in a particle and a resin covers the resultant lump so as to form a capsule. From the disclosed structure, it was expected that the desired light transmission as well as the desired static charge holding function would be exhibited. However, the desired transparency was not obtained due to the fact that light was scattered at the interface between the coloring agent region and the resin. As noted, a polymerization toner, which exhibits the desired static charge holding function as well as the desired transparency, has not yet been introduced into the market.

SUMMARY OF THE INVENTION

A first object of the present invention is to provide an electrostatic image developing toner which is not affected by a residual material present on the surface of toner particles and does not result in variation of the amount of static charge at high temperature as well as at high humidity.

A second object of the present invention is to provide an electrostatic image developing toner to form multicolor images, which results in suitable dispersibility of a coloring agent into a toner particle and also results in light transmission images with high transparency, and results in especially high quality images for overhead projectors.

A third object of the present invention is to provide an electrostatic image developing toner which results in uniform density of halftone images under such operation conditions, of an image forming apparatus, as repetition of non-operation over a relatively long period.

A fourth object of the present invention is to provide an electrostatic image developing toner capable of invariably producing multicolor images with minimal color difference while being not affected by a coloring agent incorporated in each color developer, at high temperature as well as at high humidity, and in an image forming apparatus which has not been operated over an extended period of time.

A fifth object of the present invention is to provide an electrostatic image developing toner capable of consistently producing, over an extended period of time, high quality images which do not exhibit blocked text but exhibit excellent developability as well as excellent reproducibility of fine lines, irrespective of the environment and conditions in which an image forming apparatus is employed.

A sixth object of the present invention is to provide a method for specifically forming digital multicolor images while employing said electrostatic image developing toner.

The present invention not only has simply improved the dispersibility of said coloring agent in toner particles, but has also made it possible to achieve the aforesaid objects. Namely, attention was paid to the structure of the polymerization toner prepared by coalescing resinous particles with toner particles. The coloring agent forms domains in said toner particles. Even though impurities, such as surface active agents, remain on the toner particle, the electrostatic image developing toner, in which domains comprised of said coloring agent are formed in the toner particle and the resultant domains comprised of said coloring agent having an optimal dispersion structure, makes it possible to exhibit a charge holding function without being affected by these effects and to form excellent images such as images with excellent transparency for overhead projectors.

When the components of said coloring agents form domains in the binding resin, and said domains have an optimum dispersion structure in a particle, an electrostatic image developing toner can be prepared which exhibits the advantages described below. Said toner does not result in variation of the amount of toner static charge such as a leak of static charge amount during standby even under employed conditions at high temperature and high humidity, or under conditions in which an image forming apparatus is used after a long interval of rest, and in addition, does not result in fogging, uneven density of halftone images, and color difference variation in multicolor images, and forms highly transparent color images for overhead projectors.

When water-dampened coloring agents in paste are employed as said coloring agents, the transparency is further improved and the variation of color difference is also further minimized.

The present invention, as well as embodiments thereof, will now be described.

1. In an electrostatic image developing toner comprising a coloring agent and toner particles, said toner particles have a matrix-domain structure, and the average of the area of a Voronoi polygon formed by the perpendicular bisecting line between the centers of gravity of domains adjacent to each other in said matrix-domain structure is from 20,000 to 120,000 $nm^2$, and the variation coefficient of the area of said Voronoi polygon is less than or equal to 25 percent.
2. The electrostatic image developing toner, described in 1, above, wherein the average of the area of said Voronoi polygon formed by the perpendicular bisecting line between the centers of gravity of domains adjacent to each other in said matrix-domain structure is from 40,000 to 100,000 $nm^2$, and the variation coefficient of the area of said Voronoi polygon is less than or equal to 20 percent.
3. The electrostatic image developing toner, described in 1 or 2 above, wherein the average of the area of said Voronoi polygon formed by the perpendicular bisecting line between the centers of gravity of domains adjacent to each other in said matrix-domain structure is from 20,000 to 120,000 $nm^2$, and the umber ratio of the domain, which forms said Voronoi polygon having an area of at least 160,000 $nm^2$, is from 3 to 20 percent of the total number of domains.
4. The electrostatic image developing toner, described in 1. through 3. above, wherein the average of the area of a Voronoi polygon formed by the perpendicular bisecting line between the centers of gravity of the domains in the exterior of a 1,000 nm radius circle having the center of gravity in the cross-section of said toner particle as the center is smaller than the average of the area of a Voronoi polygon formed by the perpendicular bisecting line between the centers of gravity of said domain in the interior of said circle.
5. The electrostatic image developing toner, described in 1. through 4. above, wherein of Voronoi polygons formed by the perpendicular bisecting line between the centers of gravity of the domains adjacent to each other in said matrix-domain structure, the number ratio of Voronoi polygons having an area of at least 160,000 $nm^2$ which come into contact with the external circumference of said toner is from 3 to 20 percent of the total number of said domains.
6. The electrostatic image developing toner, described in 1. through 5. above, wherein said toner particle is comprised of a matrix-domain structure and has a region comprising no domain portion of a length of 500 to 6,000 nm as well as a height of 100 to 200 nm along the circumference of the cross-section of said toner particle.
7. The electrostatic image developing toner, described in 1. through 6. above, wherein said domains are comprised of ones having different luminance.
8. The electrostatic image developing toner, described in 1. through 7. above, wherein said resin forms the portion corresponding to said matrix, and said coloring agent forms the portion corresponding to said domain.
9. The electrostatic image developing toner, described in 1. through 8. above, wherein said coloring agent is prepared employing a water-dampened coloring agent paste.
10. The electrostatic image developing toner, described in 1. through 9. above, wherein said toner has a number variation coefficient of less than or equal to 27 percent in the number particle size distribution, and also has a variation coefficient of the shape factor is less than or equal to 16 percent.
11. The electrostatic image developing toner, described in 1. through 10. above, wherein said toner is comprised of toner particles without corners of at least 50 percent by number, and has a number variation coefficient in the number particle size distribution of less than or equal to 27 percent.
12. The electrostatic image developing toner, described in 1. through 11. above, wherein said toner is comprised of toner particles having a shape factor of 1.2 to 1.6 of at least 65 percent by number, and has a particle number variation coefficient, in the number particle size distribution, of less than or equal to 27 percent.
13. The electrostatic image developing toner, described in 1. through 12. above, wherein said toner is comprised of toner particles having a number average particle diameter of 3 to 9 $\mu$m.

14. The electrostatic image developing toner, described 1. through 13. above, wherein said toner has a sum (M) of at least 70 percent, wherein said sum (M) consists of relative frequency (m1) of toner particles which are included in the most frequent class and relative frequency (m2) of toner particles which are included in the second most frequent class in the histogram which shows the particle size distribution based on the number of particles, which is drawn in such a manner that regarding said toner, when the particle diameter of toner particles is represented by D (in $\mu$m), natural logarithm in D is taken as the abscissa, and said abscissa is divided into a plurality of classes at an interval of 0.23.
15. The electrostatic image developing toner, described in 1. through 14. above, wherein said toner is prepared by salting-out/fusing resinous particles prepared via a process of polymerizing a polymerizable monomer and coloring agent particles.
16. The electrostatic image developing toner, described in 1. through 15. above, wherein said resinous particles are prepared by polymerizing a polymerizable monomer in a water based medium.
17. The electrostatic image developing toner, described in 1. through 15. above, wherein said toner particles are prepared by aggregating and fusing resinous particles and coloring agent particles in a water based medium.
18. The electrostatic image developing toner, described in 1. through 15. above, wherein said toner particles are prepared by salting out/fusing resinous particles prepared by a multi-step polymerization method and coloring agent particles.
19. The electrostatic image developing toner, described in 1. through 18. above, wherein said toner particles are comprised of a resinous layer which is formed by fusing resinous particles comprising a crystalline material, toner particles, and resinous particles comprised of a resin having a lower molecular weight than the resin of said resinous particles, employing a salting-out/fusion method.
20. In an image forming method comprised of processes in which an electrostatic latent image, formed on a photoreceptor, is visualized employing a developer, and said visualized image is transferred onto a recording medium and thermally fixed, an image forming method wherein said thermal fixing is carried out employing a fixing unit having a looped belt-shaped film.
21. The image forming method, described in 20. above, wherein an electrostatic latent image is formed utilizing digital exposure onto a photoreceptor.

BRIEF DESCRIPTION OF THE DRAWINGS

FIG. 6 is a view describing a configuration of one example of a fixing unit applied to the present invention;

FIG. 8 is a schematic view describing a toner having no corners or corners.

DETAILED DESCRIPTION OF THE INVENTION

The toner according to the present invention contains a resin, and a colorant, and may further contain a charge controlling agent, an anti-offset agent and so on. The toner particles of the present invention are comprised of a domain-matrix structure. The domain-matrix structure, as described herein, refers to the structure in which in a continuous phase, island-shaped phases having closed interfaces are located. Namely, in the toner of the present invention, each components which constitute toner particles, are mutually insoluble and forms phases independently, so that toner particles are formed so as to comprise said domain-matrix structure. The island of colorant forms a domain in a continuous matrix phase composed of resin as a nature of the toner composition.

The fact that the toner particles of the present invention are comprised of a domain-matrix structure can be confirmed by detecting regions with different luminance in the cross-sectional photograph imaged employing a transmission type electron microscope. Namely, it is confirmed that in the toner particle of the present invention, granular domains (phases comprised of colorants) having different luminance are located in the continuous phase (the phase of the binding resins). Further, based on the results obtained by said electron microscopic observation, factors such as the number of domains in one toner particle, and the shape factor of the domain, which specify the domain-matrix structure in the toner particle, are obtained as numerical figures.

The luminance in the photograph of a transmission electron microscope, as described herein, is formed by visualizing difference in transmittance of the electron beam generated by difference in the crystal state of each element constituting toner particles, namely binding resins, and colorants. Generally, the colorants are imaged at a low luminance due to their lower electron beam transmittance than the binding resins.

Low luminance, as described in electron microscopic photographs, refers to one in 0 to 99 gradations when the luminance signals of pixels are divided into 256 gradations, while medium luminance refers to one in the range of 80 to 160 gradations, and high luminance refers to one in 126 to 255 gradations. However, in the present invention, relative luminance may be taken into account.

As described above, in the present invention, by discriminating each component in toner particles based on said luminance, it is possible to visually identify or discriminate each component utilizing electron microscopic photographs that domains are as domains and a non-domain portion is as the non-domain portion. Herein, by utilizing an image analysis unit installed in said electron microscope, luminance information is converted to image information which can be visually discriminated.

Figure 1:
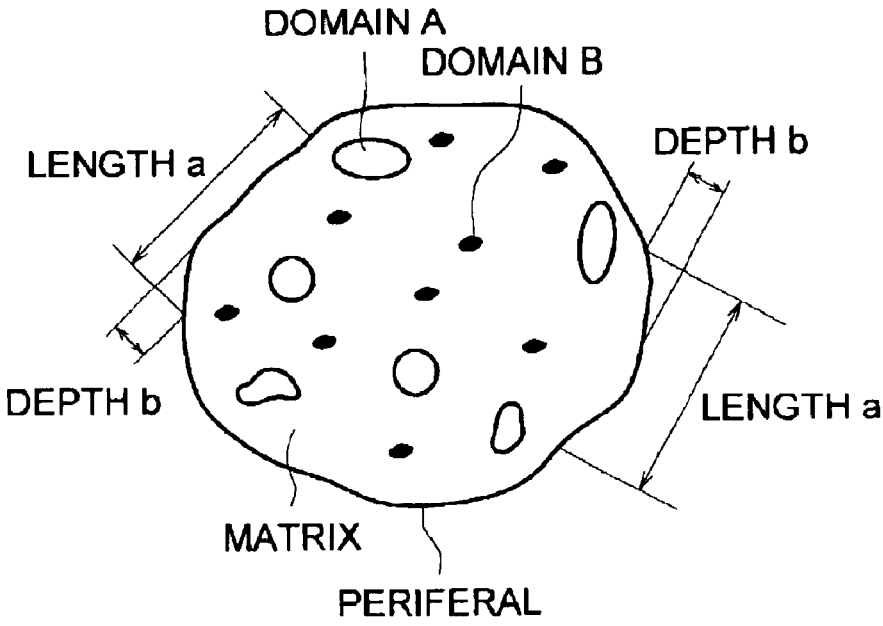
FIGS. 1(*a*) and 1(*b*) are schematic views describing a toner particle comprised of the matrix-domain structure of the present invention.
Figure 1:
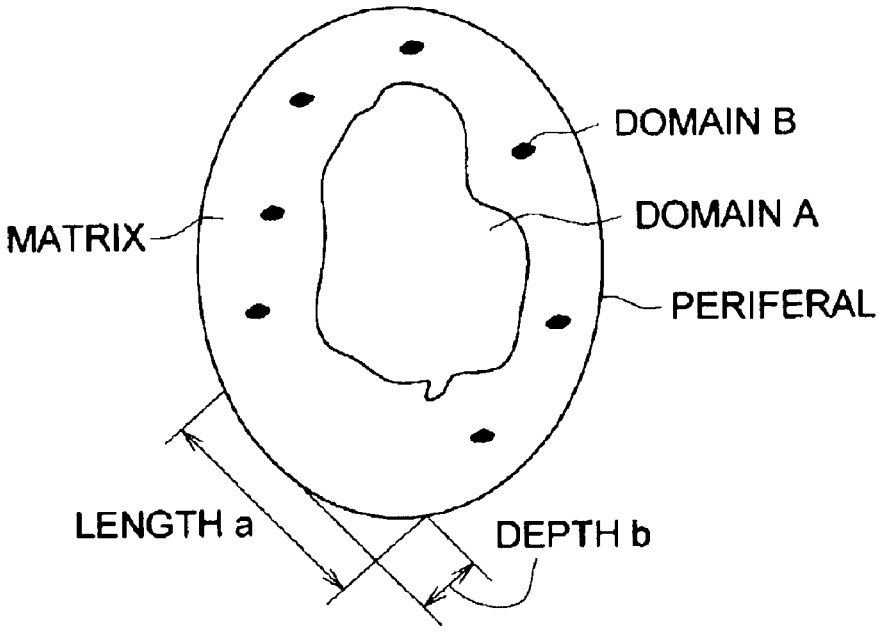

FIG. 1 shows a schematic view showing one example of each of toner particles (a) and (b) comprised of a domain-matrix structure of the present invention. In electron microscopic photographs, as shown in said schematic views, it is observed that the toner particles of the present invention are comprised of a continuous phase and domain portions. Further, there are regions with length "a" and depth "b" along the outer circumference of the toner particle, which comprises no domain portions.

It is observed that a binder resin, which is one of the components of the toner, constitutes matrix structure in a continuous phase in a toner shown in FIG. 1(*a*).

It is possible to fully observe the structure of a toner particle, employing any of several types of transmission type electron microscopes such as "LEM-2000 Type (manufactured by TOPCON CORP.)", which are well known in this art. In the present invention, projections of at least 1000 toner particles were prepared by a factor of 10,000 employing said transmission type electron microscope. Employing the resultant projections, desired values such as the number of domain portions in the interior of a toner are calculated.

In the present invention, imaging employing said transmission type electron microscope is carried out employing the method which is commonly known to measure toner particles. Namely, a specific method for measuring the cross-section of a toner is as follows. After sufficiently dispersing toner particles into an epoxy resin which hardens at normal temperature, they may be buried and hardened. After dispersed into a fine styrene powder having a particle diameter of approximately 100 nm, the resultant dispersion is press-molded. Subsequently, if desired, the resultant block is dyed with triruthenium tetraoxide and triosmium tetraoxide in combination. Thereafter, a thin slice sample is prepared by cutting the resultant block, employing a microtome fitted with a diamond blade. Employing said sliced sample, the cross-sectional structure of toner particles is imaged employing a transmission type electron microscope (TEM). Employing the resultant photographs, the shape of the region of crystalline materials in the toner particles was visually confirmed. At the same time, employing an image processing unit, "LUZEX F", manufactured by NIRECO CORP., Ltd., installed in said electron microscope, the imaged information is processed, and the characteristics of domain in a toner particle are obtained.

The structure of the toner particles of the present invention is specified based on the methods as above. Factors, which specify the structure of the toner particles of the present invention, will now be detailed.

In toner particles the colorant domains are shown as Domain B in FIGS. 1(*a*) and 1(*b*). The toner particles having matrix-domain structure may contain a domain other than the colorant within the particle as shown in the drawing. The luminance of domains comprised of crystalline materials is different from that of domains comprised of said colorants. As a result, it is possible to discriminate them in electron microscopic photographs. The domains comprised of colorant are specified based on the area of the Voronoi polygon described below.

The values specifying the domestic portion are calculated utilizing an image analysis unit fitted with an electron microscope, based on the image information observed by said electron microscope.

Figure 2:
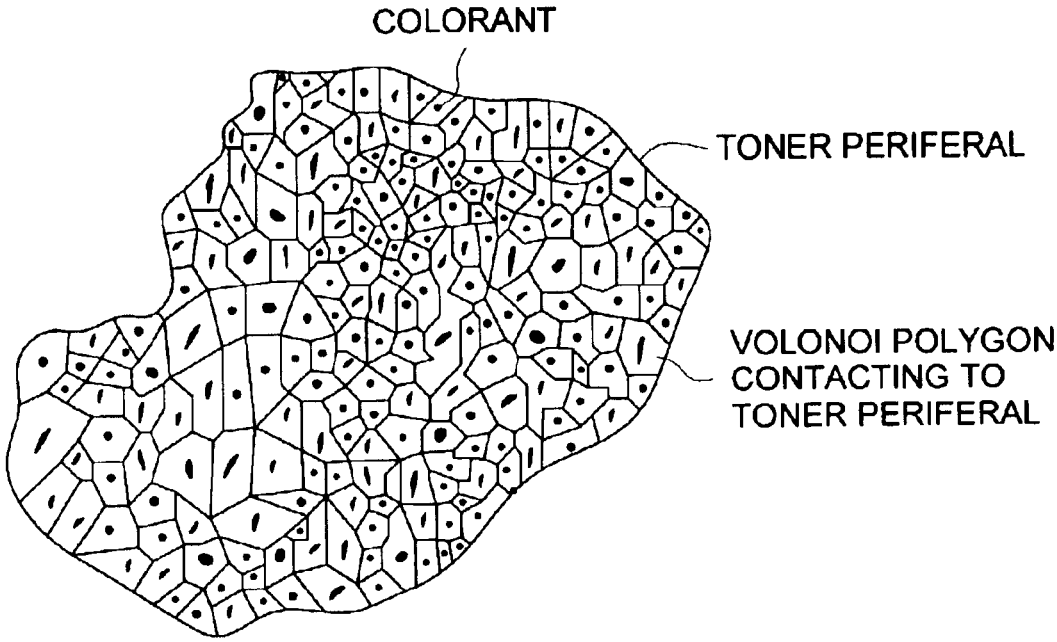
FIG. 2 is a schematic view of a toner particle comprised of a matrix-domain structure which is divided into Voronoi polygons.

The area of the Voronoi polygon employed in the present invention, as described herein, refers to the domain portion occupying state in the toner particle. The Voronoi polygon or Voronoi polyhedron, as described herein, is as follows. As described in, for example, "Iwanami Rikagaku Jiten (Iwanami Physical and Chemical Dictionary)", when many points are scattered in a space or on a plane, the whole space or the whole plane is divided into polyhedrons or polygons by creating a perpendicular bisecting plane or a perpendicular bisecting line of the adjacent points. The polyhedron formed as above is called Voronoi polyhedron, while the polygon formed as above is called Voronoi polygon. Such division of said space as well as said plane is called Voronoi division. FIG. 2 shows one example of the toner particle of the present invention which is divided by a Voronoi polygons.

As described above, in the present invention, as the scale showing the domain portion occupying ratio in the toner particle, the domain portion occupying state in the domain-matrix structure of the toner particle is shown employing the area of the Voronoi polygon obtained by said Voronoi division. Namely, in the present invention, the center of gravity of the domain in the toner particle is focused on, and a polygon is formed employing a perpendicular bisecting line between the centers of gravity of adjacent domains. These polygon areas are calculated based on photographs obtained employing a transmission type electron microscope while employing the image analysis device installed in said transmission type electron microscope.

A large Voronoi polygonal area indicates that the distance between the centers of gravity of adjacent domains is large. Namely, it indicates that the domain portion occupying state of in the particle is not dense. On the other hand a small Voronoi area indicates that the distance between the centers of gravity of adjacent domains is short. Namely it indicates that the domain occupying state in the particle is in a dense state. In the present invention, the Voronoi polygons of 1,000 toner particles were determined and the average value was calculated.

The Voronoi polygon is generally and mathematically defined employing the formula described below.

<Area of Voronoi Polygon>

The set of Voronoi polygon V(i) regarding N independent point P(i) ($1 \leqq i \leqq = N$) in two-dimensional space R2 or three-dimensional space R3 is:

$$V(i)=\{X \mid |X-P(i)|<|X-P(j)| \text{ for all i and j}\}$$

wherein X and P each represent the position vector and || represents the distance in Euclidean space.

V(i) as defined above assumes that in R2, a Voronoi polygon is formed, and in R3, a Voronoi polyhedron is formed. When V(i) is directly adjacent to V(j), it is defined that the boundary between Voronoi polygons becomes one part of the perpendicular bisecting line connecting point P(i) with point P(j). Said Euclidean space equals one which is defined and described in "Suurikagaku Daijiten (Mathematical Science Encyclopedia)".

Further, the center of gravity of the toner particle of the present invention, as well as the center of gravity of each domain in the toner particle is obtained employing the moment of images, which is automatically calculated by the image analysis device installed in said transmission type electron microscope. Herein, the coordinates of the center of gravity of the toner particle are obtained as follows. The product of the luminance of a minute area at an optional point of the toner particle, and the coordinates of said optimal point are obtained. Further, regarding all the coordinates in which all toner particles exist, the product of the luminance and the coordinate values is obtained. Then, the coordinates of the center of gravity are obtained by dividing the sum of the resulting products by the luminance of the toner particle (the sum of the luminance at each coordinate point obtained as above). Further, the center of gravity of the domain is obtained in the same manner as above by obtaining the luminance at an optional coordinate point in the domain. As noted, the coordinates of the center of gravity of the toner particle of the present invention, as well as the coordinates of the of center of gravity of each domain in the toner particle are calculated based on the luminance at each of the optional points. Namely, said coordinates are calculated based on the brightness and darkness of images.

In the present invention, the average area of the Voronoi polygon formed by the perpendicular bisecting line between the centers of gravity of domains, which are directly adjacent to each other in the toner particle, is from 20,000 to 120,000 $nm^2$, and the variation coefficient of the average of said area is no more than 25 percent. The variation coefficient of the area of the Voronoi polygon in the present invention is calculated based on the formula below:

variation coefficient of the area of the Voronoi $$\text{polygon}=(S1/K1)\times 100 \text{ (in percent)}$$

wherein S1 is the standard deviation of the area of the Voronoi polygon in the toner particle, and K1 is the average area of the Voronoi polygon.

Further, the average area of the Voronoi polygons, which are adjacent to each other, is preferably from 40,000 to 100,000 $nm^2$, and its variation coefficient is no more than 20 percent.

Further in the other embodiment, the average area of the Voronoi polygons, which are adjacent to each other, is from 20,000 to 120,000 $nm^2$, and the ratio of the matrices having area of 120,000 $nm^2$ or more is 3 to 20% by number to whole matrix. The ratio of the matrices having area of 50,000 $nm^2$ or less is preferably 30% and more preferably 60% by number or to whole matrix in a toner particle in view of uniform charging distribution.

The average area of the Voronoi polygon formed by the perpendicular bisecting line between the centers of gravity of the domains, which are adjacent to each other in the toner particle of the present invention, is in the range of 20,000 to 120,000 $nm^2$. When the average is fallen within said range, the domain occupying state in the toner particle becomes preferable. For example, said fact indicates that colorants which exist as a domain in the particle is effectively incorporated into the toner particle. As a result, it is preferable because it displays the effects of the present invention.

The variation coefficient of the average area of the Voronoi polygon formed by domains which are adjacent to each other, as described herein, specifies the fluctuation of the area of the Voronoi polygon, namely it specifies the fluctuation of the domain portion occupying state in the toner particle. The variation coefficient of the average area of the Voronoi polygon is commonly in the range of no more than 25 percent, and is preferably in the range of no more than 20 percent. Incidentally, it is not required that the variation coefficient be 0 percent, namely, the state in which the average area of the Voronoi polygon results in no fluctuation, or in other words, any toner particle being in the same domain occupying state.

In the present invention, it is not preferable that the variation coefficient of the average area of the Voronoi polygon exceeds 25 percent, because the fluctuation among the areas of the resulting Voronoi polygons becomes excessively large, making it extremely difficult to discern the effects of the present invention during image formation.

Further, in the present invention, there are 3 to 20% domains by number having an area of Voronoi polygons of at least 160,000 $nm^2$ in one toner particle. Said fact implies that those domains are suitably scattered so that each domain is suitably positioned so as to maintain the desired distance. This also means that said domains are not locally positioned and colorants are effectively incorporated into the toner particle.

Further, in the present invention, it is characterized that the non-domain portion of the Voronoi polygon formed by the domain, which is located within the specified range from the center of gravity of the toner particle, is smaller than that of the Voronoi polygon which is formed by the domain beyond said range. Namely, in the present invention, the average area of the Voronoi polygon formed by an domain, which is located beyond the radius 1,000 nm circle having its center at the center of gravity of the toner particle, is greater than that of the area of the Voronoi polygon formed by an domain which is located in said 1,000 nm radius circle. This fact implies that in the toner particle, domains are sparsely scattered in the area somewhat farther from the center of gravity of the toner particle. By satisfying said conditions, in the toner of the present invention, the domains are suitably scattered in the toner particle so that the effects, which are obtained by achieving the present invention, are evident.

Further, in the toner of the present invention, the toner particle is comprised of a domain-matrix structures, but has regions, in which no domains are located, in the region along the outer circumference. In the schematic views in FIGS. 1(*a*) and 1(*b*). Toner Particle (a) and Toner Particle (b), the region, which is shown by the length of "a" and the depth of "b" along the outer circumference of the cross-section of the toner particle, comprises no domains. Namely, in the toner of the present invention, it is confirmed that in the region along the outer circumference of the cross-section of the toner particle, said toner comprises regions which do not comprise an domain portion having a depth of 120 to 180 nm and a length of 800 to 4,000 nm.

In the present invention, it is assumed that the absence of domains in the specified regions along the outer circumference of the toner particle specifically contributes to effectively enhancing charge maintaining characteristics and preventing scattering of light closed to the surface of the toner particles. Further, it is also assumed that said absence of domains functions to suitably disperse colorant into the interior of the particle, and to effectively accelerate the effect found by the invention. It is difficult for those having no region containing colorant along the outer circumference of the toner particle to find the effect of the invention because the charge maintaining characteristics of the toner particles decreases.

The colorant employed in the invention or colorant particles is added to the toner particles as dispersion liquid by such a way that the colorant is made as fine particles having weight average particle diameter of 30 to 500 nm. A practical method to make the colorant to be fine particles having specific weight average particle diameter mentioned above will be explained later. It is effective to employ the colorant that is dispersed with a dispersion device shown by FIG. 3 for controlling the structure of the toner particles having the Voronoi polygon according to the invention. Wet colorant paste is effectively employed to enhance the effect of the invention such as improvement of transparency of OHP sheet. The practical preparation method of wet colorant paste will be described later.

The non-domain portion of the toner particle comprised of said domain-matrix structure of the present invention is comprised of resins.

The toner particle having domain-matrix structure according to the invention may comprise other domain component than the colorant. One example thereof is a crystalline material. The crystalline material constituting said domain portions, as described in the present invention, refers to the organic compound, having a melting point, which is preferably a hydrocarbon having an ester group in its structure. The melting point of the crystalline materials in the toner particles of the present invention is lower than the softening point of the toner and is specifically 130° C. or lower. Said organic compounds preferably comprise an ester group in their structure and include crystalline polyester compounds.

A melting point of the crystalline materials constituting the domain portions may be confirmed by employing DSC, and the fact that said crystalline materials exhibit crystal properties may be confirmed employing means such as an X-ray diffraction apparatus. Further, crystalline materials incorporated into the toner of the present invention include those which exhibit functions as a releasing agent. The melting point of such crystalline materials is preferably from 50 to 130° C., and is more preferably from 60 to 120° C. It is possible to lower the melt viscosity of toners comprising crystalline materials having a melting point in the range of 50 to 130° C., whereby it is possible to improve adhesion properties to sheets of paper. In addition, even though said crystalline materials are incorporated, excellent off-setting resistance is exhibited due to the fact that the elastic modulus in the high temperature region is maintained in the preferable range.

The melting point of crystalline materials, as described herein, refers to the value determined employing a differential scanning calorimeter (DSC). Specifically, the temperature, which shows the maximum peak of endothermic peaks which are measured by increasing the temperature from 0 to 200° C. at a rate of 10° C./minute (the first temperature increasing process) is designated as the melting point. Said melting point equals "the endothermic peak, P1 in the first temperature increasing process utilizing DSC".

Listed as the specific apparatus for determining melting points may be DSC-7 manufactured by Perkin-Elmer Corp. The specific method for determining melting points employing said differential scanning calorimeter (DSC) is as follows. After a sample is set aside at 0° C. for one minute, the temperature is raised to 200° C. at a rate of 10° C./minute. The temperature, which exhibits the maxium endothermic peak measured during said opertion, is designated as endothermic peak P1 in the first temperature increasing process. Subsequently, after said sample is set aside at 200° C. for one minute, the temperature is lowered at a rate of 10° C./minute. The temperature, which exhibits the exothermic peak measured during said operation, is designated as exothermic peak P2 during the first cooling process.

In crystalline compounds employed in the toner of the present invention, endothermic peak Pi during the first temperature increasing process, determined by employing DSC, is preferably located from 50 to 130° C., and is more preferably located from 60 to 120° C. Further, exothermic peak P2 during the first cooling process, determined by employing DSC, is preferably located from 30 to 110° C., and is more preferably located from 40 to 120° C. Herein, the relationship of $P1 \geqq P2$ is held between said endothermic peak P1 and exothermic peak P2. Temperature difference, P1−P2 is not particularly limited, but is preferably no more than 50° C.

By incorporating crystalline materials having thermal characteristics as previously described, it is possible to achieve excellent off-setting resistant effects (over a wide fixable temperature range) and excellent fixability (being an enhanced fixing ratio). In order to exhibit the desired effects of the present invention, it is preferable that binding resins and crystalline materials are in a state of phase separation with each other.

The crystalline materials melt suddenly. As a result, it is possible to decrease the melt viscosity of the entire toner as well as to enhance fixability. Further, due to the fact that they are in a sate of phase separation with each other, off-setting resistance is not degraded because it is possible to retard said decrease in the elastic modulus in the high temperature region.

When said endothermic peak P1 is lower than 50° C., the resultant fixability is improved due to the low melting temperature, but the resultant storage stability is degraded. On the other hand, when said endothermic peak P1 exceeds 130° C., the resultant melting temperature is raised. As a result, it is impossible to improve the fixability as well as the off-setting resistance.

When said exothermic peak P2, which represents a recrystallization state, is lower than 30° C., it is impossible to achieve recrystallization unless cooled to a fairly low temperature, whereby materials having such exothermic peaks are in a low crystallization state. As a result, said materials are not capable of contributing to an improvement of fixability. On the other hand, when said exothermic peak P2 exceeds 110° C., the resultant recrystallization temperature becomes excessively high and the so-called melting temperature is raised. As a result, the resultant fixability at low temperature is degraded.

The toner employed in the invention is detailed.

The toner having a variation coefficient of the toner shape coefficient of not more than 16 percent, as well as having a number variation coefficient in the is preferably employed because high image quality, which is exhibited by excellent cleaning properties, as well as excellent fine line reproduction, can be obtained over an extended period of time.

The inventor has found that a corner part of the toner particle becomes round during long time usage in the developing apparatus and the rounded part accelerates the additives embedded in the toner particle, whereby charging amount varies, and fluidity and cleaning ability are reduced.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

External additives are not embedded into toner particles and sharp charge distribution is obtained when the shape of the toner particles are specified and unformed. The toner of which a number ratio of toner particles having a shape coefficient of 1.2 to 1.6 is at least 65 percent, and further the variation coefficient of said shape coefficient is not more than 16 percent, it is possible to obtain high image quality over an extended time of period, which exhibits excellent cleaning properties, as well as excellent fine line reproduction.

The number particle size distribution as well as the number variation coefficient of the toner of the present invention are measured by either a Coulter Counter TA-II or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 $\mu$m, and the volume as well as the number of toner particles with at least 2 $\mu$m was measured to calculate the particle size distribution as well as the average particle diameter. The number particle size distribution as described herein represents the relative frequency of toner particles with respect to the toner diameter, and the number average particle diameter represents the median diameter in the number particle size distribution, that is Dn50.

The number variation coefficient in the number particle size distribution of toner is calculated by the formula described below:

$$\text{Number variation coefficient}=(S/Dn)\times 100 \text{ (in percent)}$$

wherein S represents the standard deviation in the number particle size distribution, and $D_n$ represents the number average particle diameter (in $\mu$m).

The number variation coefficient of the toner of the present invention is generally not more than 27 percent, and is preferably not more than 25 percent. By controlling the number variation coefficient to be below 27 percent, voids in the transferred toner layer decrease to improve fixing property as well as to minimize offsetting. Further, the charge distribution narrows, and the transfer efficiency is enhanced, improving image quality.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle diameter while controlling rotational frequency, employing a centrifuge.

The shape coefficient of the toner particles will be detailed. It is preferable the ratio of toner particles having a shape coefficient of 1.2 to 1.6 is 65 percent by number and variation coefficient of said shape coefficient is 16 percent. The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

The toner particles of the present invention, which substantially have no corners, as described herein, mean those having no projection to which charges are concentrated or which tend to be worn down by stress. Namely, as shown in FIG. 8(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 8(*b*) and 8(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 1,000 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Thus, since the charge amount distribution is narrowed, it is possible to stabilize chargeability, resulting in excellent image quality over an extended period of time.

The toner having no corners can be obtained by various methods. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

Aperture: 100 μm

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

Particle diameter of the toner is described. The toner particles employed in the invention have average diameter of 3 to 9 μm, preferably 4.5 to 8.5 μ. Particle diameter is controlled by adjusting concentration of coagulant (salting agent), amount of organic solvent, fusing time, composition of polymer during the toner preparation.

The transfer efficiency is improved, half-tone image quality, and fine line or dot image quality is improved by employing the toner having number average diameter of 3 to 9 μm. It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like. The particle diameter distribution is obtained by employing the Coulter Multisizer to which an interface outputting the particles diameter distribution (product of NIKKAKI Co.) and a personal computer.

(Producing Method of Toner)

The resin particles of the toner can be produced by preparing resin particles by polymerization of polymeric monomer in an aqueous medium. The methods include (1) a process preparing particles by a suspension polymerization method, or (2) an emulsion polymerization method or a mini-emulsion polymerization method and then salting out/coagulating.

Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

Emulsion Polymerization and Mini-Emulsion Polymerization

The toner according to the invention can be also obtained by salting-off/coagulating resin particles prepared by the emulsion polymerization or the mini-emulsion polymerization.

For example, the methods described in JP O.P.I. Nos. 5-265252, 6-329947 and 9-15904 are applicable. The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

The toner particles may be prepared by a process of polymerizing a polymerizable monomer in which a crystalline material is dissolved. A crystalline material may be incorporated in polymerizable monomer liquid in a melted or dissolved. Resin particles containing a crystalline material in a dispersion of fine particles are called composite resin particles.

The toner according to the invention can be also obtained by salting-off/coagulating resin particles prepared by the multi-step polymerization process.

Preparation Method of the Multi-Step Polymerization

The production process comprises, for example, the following processes:

1. A multi-step polymerizing process
2. A salting-out/coagulation process to produce a toner particle by salting-out/coagulating the compound resin particles and colored particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

The multi-step polymerization process is a process for preparing the composite resin particle having broader molecular weight distribution so as to obtain enhanced anti-off-set characteristics. A plural of polymerization reaction is conducted in separate steps so that each particle has different layers having different molecular weight. The obtained particle has a gradiant of molecular weight from the center to the surface of the particle. For example, a lower molecular weight surface layer is formed by adding a polymerizable monomer and a chain transfer agent after obtaining a higher molecular weight polymer particles dispersion.

It is preferred from the viewpoint of the stability and the anti-crush strength of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

(Two-Step Polymerization Method)

The two-step polymerization method is a method for producing the composite resin particle comprised of the central portion (core) containing the crystalline material comprising the high molecular weight resin and an outer layer (shell) comprising the low molecular weight resin.

In concrete, a monomer liquid is prepared by incorporating the crystalline material in a monomer, the monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

In concrete, a suspension of the resin particles prepared by the polymerization treatment (the first polymerization step) according to a usual procedure is added to an aqueous medium (an aqueous solution of a surfactant) and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which at least 50 percent, by weight of water, is incorporated. Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers. The diameter of dispersed particles is 10 to 1,000 nm, and is preferably 30 to 300 nm. Phase structure of crystalline material in a toner particle, namely the FERE diameter, the shape coefficient and variation coefficient thereof, may be controlled by broadening the distribution of dispersion particle diameter.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer "ELS-800" (produced by Ohtsuka Denshi Co.).

Glass transition temperature (Tg) of the composite resin particles is preferably from 48 to 74° C., and more preferably from 52 to 64° C.

The Softening point of the composite resin particles is preferably from 95 to 140° C.

The toner particles according to the invention can be obtained as a resin particles containing colorant which are prepared by salting-out/fusion of resin particles and a colorant. They are also obtained by adding a resin after the process of salting-out/fusion, whereby a resin layer is formed on the surface of the resin particle containing a colorant. The method is described below.

<Salting-Out/Fusion Process>

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. A resin layer may be formed on the surface of the resin particles containing a colorant by adding a resin, particularly that having smaller molecular weight than that of the composite resin particle. The resin having smaller molecular weight is preferably added as a latex.

(Digestion Process)

The digestion process is a process following to the salting-out/fusion process, wherein the crystalline material is subjected to phase separation by continuing agitation with constant strength keeping temperature close to the melting point of the crystalline material, preferably plus minus 20 centigrade of the melting point, after the coagulation of fine particles. The FERE diameter, the shape coefficient and variation coefficient thereof, may be controlled in this process.

(Fine Coloring Agent Particles)

Figure 3:
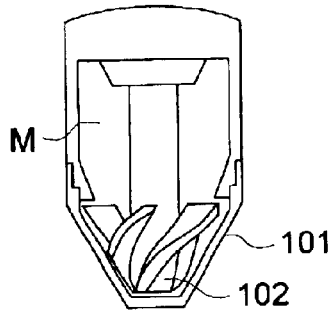
FIG. 3 is a view of a stirring apparatus to prepare coloring agent particles which are incorporated into toner particles comprised of the matrix-domain structure of the present invention.
Figure 3:
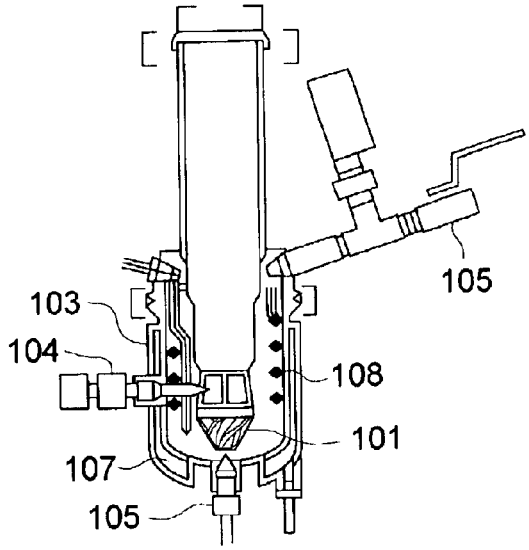
Figure 3:
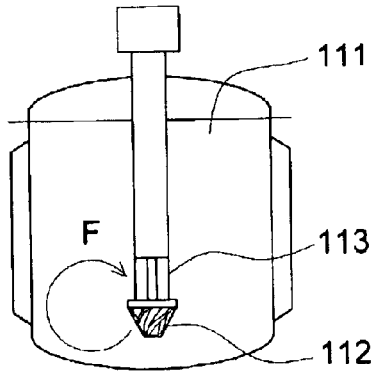

Fine coloring agent particles are prepared by uniformly dispersing coloring agent particles in a water based medium, comprising surface active agents. A dispersing apparatus, shown in FIG. 3, is one example which is preferably employed to finely disperse coloring agent particles. A shearing force is generated by a screen, compartmentalizing a stirring chamber, and a rotor rotated at a high speed in said stirring chamber. Said coloring agent is finely dispersed by the action of said shearing force (in addition, the action of the collision force, pressure variation, cavitation, and the potential core), whereby fine particles are prepared.

A toner structure such as said Voronoi polygons is effectively controlled by dispersing said coloring agent employing the dispersing apparatus shown in FIG. 3.

Further, effectively employed as coloring agents used in the present invention are water-dampened coloring agents in a paste state to enhance of the effects of the present invention, and in addition, to control the toner structure. Said water-dampened coloring agent paste will now be described.

The use of said water-dampened coloring agent paste, as the coloring agent, is effective to enhance the transparency of images for overhead projectors, as well as to minimize the color variation.

The use of toner particles, having the specified toner shape and distribution, together with said water-dampened coloring agent paste, further enhances the desired effects of the present invention. Said water-dampened coloring agent paste, having a coloring agent content of 15 to 75 percent by weight, is preferably employed.

It is possible to prepare said water-dampened coloring agent paste in such a manner that after synthesizing said coloring agent, the resultant product is purified employing recrystallization and the like, followed by filtration and dehydration, and the amount of the resultant coloring agent is adjusted to obtain the specified content. Alternatively, water is added to previously dried coloring agent powder, and if desired, the resulting mixture is subjected to wet type pulverization. The resultant mixture is filtrated and dehydrated. Thereafter, the amount of the resultant coloring agent is adjusted to the desired content, whereby a water-dampened coloring agent paste is prepared. Namely, the water-dampened coloring agent paste, as described in the present invention, refers to one which is not dried after wet type pulverization or purifying process during the production processes and contains water so that said coloring agent particles can not be coagulated, and is also called a wet cake. The coloring agents, employed in the present invention, may be organic pigments, and in addition, dyes or inorganic pigments, and those, which form a water-dampened coloring agent paste, are preferably employed.

Said water-dampened coloring agent paste will now be specifically described. After completing its synthesis reaction, a coloring agent is commonly washed and purified utilizing water. Therefore, said coloring agent passes through a water-dampened state and thereafter, is filtrated, dried and pulverized, whereby a powdered coloring agent is prepared. However, drying after filtration results in solid coagulation. As a result, when the resultant coagulant is physically crushed, it is impossible to finely crush said coagulant into the sate of primary particles. However, when the coloring agent is subjected to a dispersion treatment employing an aqueous surface active agent solution at the stage of the water-dampened state prior to drying, coloring agent particles are hardly subjected to coagulation, whereby it is possible to obtain a finely dispersed state.

Further, as said water-dampened coloring agent paste, a water-dampened coloring agent paste, which has been subjected to a milling treatment such as salt milling or solvent milling may be employed. Particularly, regarding the use which requires extremely fine coloring agent particles, by carrying out a surface treatment utilizing a water-dampened paste without drying after said salt milling, the resultant modification effects may be enhanced. Salt milling, as described herein, refers to the treatment in which a coloring agent is finely pulverized in such a manner that generally, pulverized sodium chloride salt and said coloring agent are subjected to milling in ethylene glycol. Further, solvent milling, as described herein, refers to the treatment method in which a coloring agent is subjected to a milling treatment in the solvent specified by said coloring agent so that said coloring agent is subjected to control so as to achieve the uniform diameter while controlling the crystal growth of said coloring agent or to obtain the desired crystalline properties utilizing crystal dislocation induced by solvents.

Listed as organic pigments employed as coloring agents are, for example, dye lake based, azo based, benzimidazolone based, phthalocyanine based, quinacridone based, anthraquinone based, dioxazine based, indigo based, thioindigo based, perylene based, perynone based, diketopyrolopyrrole based, anthoanthrone based, isoindolinone based, nitro based, nitroso based, anthraquinone based, flavanthrone based, quinophtharone based, pyranthrone based, and indathrone based pigments. The diameter of employed pigment particles is preferably from 30 to 10,000 nm, is more preferably from 30 to 500 nm, and is further more preferably from 50 to 300 nm.

In order to enhance dispersibility, coloring agents can be subjected to a surface treatment employing a sulfonating agent. A method for such will be described below. By selecting the dispersing solvents in the reaction system, which do not react with said sulfonating agent, as well as which do not dissolve or hardly dissolve said coloring agents, it is possible to utilize sulfonation reaction commonly carried out in organic reactions. Employed as sulfonating agents are sulfuric acid, fuming sulfuric acid, sulfur trioxide, chlorosulfuric acid, fluorosulfuric acid, and amidosulfuric acid. In addition, when pigments are decomposed or modified due to excessively high reactivity of sulfur trioxide or the reaction is not controlled as desired due to its high acidity, it is possible to carry out sulfonation employing complexes of sulfur trioxide and tertiary amine (refer to, for example, "Shin-Zikken Kagaku Kohza (New Lectures of Chemical Experiments)", Volume 14, Item 1773, Maruzen). Further, when individually used strong acid, such as sulfuric acid, fuming sulfuric acid, chlorosulfuric acid, or fluorosulfuric acid, easily dissolves said pigment so as to react with a single molecule, in order to retard the resulting reaction, care is required with regard to the type of solvents as well as the used amount. It is impossible to specify the type of solvents in said reaction, the reaction temperature, the reaction time, and the type of sulfonating agents, since they vary depending on the type of coloring agents as well as the reaction system. However, listed as usable solvents are sulfolane, N-methyl-2-pyrrolidone, dimethylacetamide, quinoline, hexamethylphosphorictriamide, chloroform, dichloroethane, tetrachloroethane, tertachloroethylene, dichloromethane, nitroethane, nitrobenzene, liquid sulfur dioxide, and trichlorofluoromethane.

Further, in a reaction system in which sulfur trioxide complexes are employed as the sulfonating agent and reaction solvents are basic solvents such as N,N-dimethylformamide, dioxane, pyridine, triethylamine, triethylamine or nitroethane, and acetonitrile which forms complexes with said sulfonating agents, said basic solvents may be employed individually or in combination with at least one of the previously described solvents. Specific reactions will now be described with reference to examples.

It is assumed that surface treated coloring agents, which have been prepared employing a coloring agent surface treatment method, result in dispersion stability through the enhancement of affinity with resinous particles which become a binding resin or a polymerizable monomer due to reaction with the reactive functional group or the aromatic ring on the surface of said coloring agent. Further, the formation of bonds of a sulfonic acid group to the surface of coloring agent particles makes it possible to uniformly acidify the treated coloring agent. As a result, it is assumed that the initial increase in the static charge is improved and images with high resolution may be obtained.

Namely, the use of water-dampened coloring agent paste pigments, having the specified shape as well as the specified content of coloring agent, enhances the dispersion of the coloring agent so as to enhance the transparency of images as well as to improve the light transmission of sheets for overhead projectors.

The content of said coloring agents, as described herein, is expressed in percent by weight of coloring agents in said water-dampened coloring paste. When said content is no more than 15 percent by weight, the shearing force applied to coloring agent particles during dispersion tends to be decreased. As a result, it becomes difficult to pulverize the coagulant of said coloring agent, and pigments are occasionally released. As a result, said content is not preferred to obtain the desired reproduction of secondary color as well as the desired transparency of sheets for overhead projectors. On the other hand, when said content exceeds 75 percent by weight, coloring agent particles tend to be coagulated due to an increase in concentration. As a result, said coloring agent tends to be not well dispersed into a toner particle. Due to that, the content exceeding 75 percent is not preferred to obtain the desired transparency of the sheets for overhead projectors.

It is possible to control the content of said coloring agent during production or by controlling the filtration conditions during purification.

Herein, surface active agents incorporated in a water based medium, which disperse coloring agent particles, are dissolved at a concentration higher than or equal to the critical micelle concentration (CMC). Employed as surface active agents may be those which are exemplified as surface active agents employed in the aforesaid polymerization process.

The weight average particle diameter (being the dispersed particle diameter) of fine coloring agent particles is commonly from 30 to 10,000 nm, is preferably from 30 to 500 nm, and is more preferably from 50 to 300 nm. When the weight average diameter of fine coloring agent particles is less than 30 nm, the coloring agent in a water based medium is subjected to marked floatation. On the other hand, when said weight average particle diameter exceeds 500 nm, coloring agent particles are not suitably dispersed, whereby they tend to result in sedimentation. As a result, it becomes difficult to introduce coloring agent particles into a toner particle. Such conditions are not so preferred because coloring agent particles are not included in a toner particle and are left released in the water based medium. Incidentally, said weight average particle diameter is determined employing an electrophoretic light scattering photometer "ELS-800" (manufactured by Ohtsuka Denshi Co.).

Fine coloring agent particles employed in the toner of the present invention are prepared as follows. After a coloring agent is charged into a water based medium comprising surface active agents, preliminary dispersion (coarse dispersion) is initially carried out employing a propeller stirrer to prepare a preliminary dispersion in which coagulated particles of said coloring agent are dispersed. The resultant preliminary dispersion is supplied to a stirring apparatus provided with a screen to compartmentalize the stirring chamber and a rotor rotated at a high speed in said stirring chamber and is subjected to a dispersion treatment (being a fine dispersion treatment), employing said stirring apparatus, whereby a dispersion comprised of fine coloring agent particles in a preferred dispersion state is prepared.

Listed as said stirring device for a dispersion treatment to prepare fine coloring agent particles in a preferred dispersion state may be "Clearmix", manufactured by M Tech Co., Ltd. Said "Clearmix" comprises a rotor (a stirring blade), and a fixed screen (a fixed ring) surrounding said rotor, and has a structure which applies a shearing force, an impact force, pressure variation, cavitation, and a potential core to the treated composition. Said treated composition is effectively emulsify-dispersed utilizing synergistic functions generated by these actions.

Namely, said "Clearmix" is originally used to prepare an emulsion (being a dispersion of fine liquid droplets). However, the inventors of the present invention discovered that a fine coloring agent particles dispersion, having a preferred average particles diameter as well as a markedly narrow size distribution, was prepared employing said "Clearmix" as an apparatus to disperse fine coloring agent particles into a water based medium.

FIG. 3(*a*) is a schematic view showing a high speed rotating rotor and a fixed screen surrounding said rotor. In FIG. 3(*a*), numeral 101 is a screen and M is a compartmentalized stirring chamber, while 102 is a high speed rotating rotor in stirring chamber M.

Rotor 102 is a high speed rotating stirring blade. Its frequency of rotation is commonly from 4,500 to 22,000 rpm, and is preferably from 10,000 to 21,500 rpm. The peripheral speed of the tip of rotor 102 is commonly from 10 to 40 m/second, and is preferably from 15 to 30 m/second.

Screen 101 provided around rotor 102 is comprised of a fixed ring constituted of many slits (not shown). The slit width is commonly from 0.5 to 5 mm, and is preferably from 0.8 to 2 mm. Further, the number of slits is commonly from 10 to 50, and is preferably from 15 to 30. The clearance between rotor 102 and screen 101 is commonly from 0.1 to 1.5 mm, and is preferably from 0.2 to 1.0 mm.

The average diameter of fine coloring agent particle as well as the particle size distribution is adjusted by controlling the frequency of rotation of rotor 102, and further, may be adjusted by selecting the shape of screen 101 as well as rotor 102. Specifically, the preferred dispersion state is obtained by combinations of screen (S1. 0–24, S1. 5–24, S1. 5–18, S2. 0–18, and S3. 0–9) and said rotor (R1 through R4). However, a further preferred state may be obtained utilizing a unit prepared by an operator.

FIG. 3(*b*) is a schematic view showing a continuous type processing apparatus (Clearmix) provided with said rotor as well as said screen. A preliminary dispersed dispersion (being a preliminary dispersion) is supplied from preliminary dispersion inlet 104, shown in FIG. 3(*b*), to a stirring chamber between screen 101 and said rotor. Screen 101 as well as said rotor is surrounded by pressurized vacuum attachment 103, and thermal sensor 106, cooling jacket 107, and cooling coil 108 are arranged. Coloring agent coagulant particles in said preliminary dispersion are provided with a shearing force generated by said high speed rotating rotor and screen 101, and thereby pulverized (finely dispersed).

Namely, coloring agent coagulated particles in the preliminary dispersion, supplied into the belt-shaped stirring chamber provided between screen 101 and said rotor, is subjected to a shearing force (mechanical energy) generated by said screen 101, and the high speed rotation of said rotor, and in addition, a collision force, pressure variation, cavitation, and the action of the potential core, so as to be pulverized (finely dispersed), whereby fine coloring agent particles are formed. The dispersion comprising said fine coloring agent particles is spouted into pressurized vacuum attachment 103 through the slits of screen 101. As a result, obtained is a dispersion comprising fine coloring agent particles, having a preferred average particle diameter as well as a narrow particle size distribution. Said dispersion, comprising fine coloring agent particles, is conveyed from dispersion outlet 105 to the next process.

Said coloring agent coagulated particles are pulverized by the action of said rotor and screen in the stirring apparatus so as to form fine coloring agent particles (dispersed particles) having a preferred average particle diameter as well as a narrow particle size distribution. The formation mechanism of said fine coloring agent particles will be explained based on a plurality of actions described below.

(1) Since in a portion near the surface of a high speed rotating rotor (being a stirring blade), the speed gradient is large, a high speed shearing region is formed at the portion near said surface. As a result, said coloring agent coagulated particles are pulverized by the shearing force generated in said region.

(2) At the rear of said rotor (being a stirring blade), when said rotor rotates at a high speed, a vacuum region is generated. Air bubbles generated by the rotation are eliminated at the stage where the flow rate of the dispersion decreases. At the same time, along with the compression of said air bubbles, impact pressure is generated. Said coloring agent coagulated particles are pulverized by the resulting impact pressure.

(3) When said rotor (being a stirring blade) is rotated at a high speed, said preliminary dispersion is provided with pressure energy. When the resulting pressure energy is rapidly released, the motion energy of said preliminary dispersion is increased. When said preliminary dispersion, which is scattered by said rotor, repeatedly passes between the releasing section (slit section) and the tightly closed section (non-slit section), the resulting pressure energy varies. As a result, pressure waves are generated, thereby pulverizing said coloring agent coagulated particles.

(4) When said preliminary dispersion, having a large motion energy, collide with said screen or other walls, said coloring agent coagulated particles, which are subjected to the resulting collision force, are pulverized, whereby fine coloring agent particles are prepared which have a narrow range of particle size distribution.

(5) When a dispersion having a high velocity energy passes through the slit sections of said screen, a jet flow is formed. In the potential core (a velocity region which is not affected by the action of a viscous flow), the surrounding flow is sucked in at a high speed. The coloring agent coagulated particles, which are subjected to the resulting energy, are pulverized, whereby fine coloring agent particles, having a narrow range of particle size distribution, are prepared.

The time to prepare a fine coloring agent dispersion is commonly from 5 to 80 minutes, and is preferably from 7 to 65 minutes. Further, when circulated, at least 5 passes are preferred, and 5 to 20 passes are more preferred. It is not preferable that said dispersion time be excessively long because dispersion is excessively carried out and the existing amount of fine particles becomes greater than desired.

In order to prepare preferably usable fine coloring agent particles, a batch type dispersing process may be carried out in which a dispersion vessel provided with a stirring apparatus, comprised of said screen and said rotor, is employed, and a coloring agent (being a water based medium comprising a coloring agent) is spouted into the water based medium housed in said dispersion vessel from the stirring chamber of said stirring apparatus. FIG. 3(*c*) is a schematic view of a dispersion vessel provided with said stirring apparatus (Clearmix), and the dispersion process is carried out employing said apparatus. In FIG. 3(*c*), numeral 111 is a dispersion vessel, 112 is a stirring apparatus, and 113 is a stirring shaft to drive said stirring apparatus 112. Said stirring apparatus 112 has the same constitution (said screen and said rotor) shown in FIG. 3(*a*).

Said preliminary dispersion (being a coloring agent coagulated particle dispersion) is introduced into said stirring chamber from the upper section of stirring apparatus 112 and is stirred utilizing a strong shearing force generated between said high speed rotating rotor and said screen, an impact force, and a turbulent flow, whereby fine coloring agent particles, having a weight average particle diameter of 30 to 300 nm, are formed, which are then spouted into dispersing vessel 111 from the slits of said screen. In said dispersion process of fine coloring agent particles, dispersion vessel 111 is subjected to a jacket structure and the temperature of the interior of dispersion vessel 111 may be controlled by flowing heated water, steam, and if desired, by flowing cold water.

When said dispersion process is carried out employing the dispersion vessel shown in FIG. 3(*c*), the spouting direction (the spouting direction of fine coloring agent particles into the water based medium) is preferably in a downward or horizontal direction. By spouting the coloring agent (being fine coloring agent particles) in the downward or horizontal direction, the water based medium flows as shown by arrow F. As a result, said coloring agent is spouted downward, and the resulting flow rises along the wall and is circulated to Clearmix. Due to that, it is possible to assuredly repeat said dispersion process, and it is also possible to uniformly provide dispersion energy to said coloring agent. As a result, it is assumed that it is possible to render the dispersed coloring agent particle diameter uniform. As described above, it is possible to effectively form fine coloring agent particles having a narrow range of particle size distribution.

Listed as dispersion devices employed for the dispersion process of said coloring agent particles may be, in addition to Clearmix, pressure homogenizers such as ultrasonic homogenizers, mechanical homogenizers, Manton-Gaulin homogenizer, and pressure type homogenizers, and medium type homogenizers such as Getzman dispersers and fine diamond mills.

As described above, coloring agent particles preferably employed in the present invention are prepared by pulverizing coloring agent coagulated particles, utilizing the action of a shearing force generated by said screen and said rotor. As a result, a dispersion is prepared which is comprised of fine coloring agent particles (fine particles near primary particles) having a suitable average particle diameter (a weight average particle diameter commonly is 30 to 10,000 nm, is preferably 30 to 500 nm, and is more preferably 50 to 300 nm) as well as a narrow range of particle size distribution (having a standard deviation, σ of less than or equal to 30). Such fine coloring agent particles (dispersion particles) are subjected to salting-out/fusion with fine resinous particles. As a result, said fine coloring agent particles are assuredly introduced into the interior of the resulting toner particle. Introduced coloring agent particles are not dislodged so that no fluctuation occurs with regard to the content ratio of said coloring agent in each of said toner particle.

As a result, when images are formed, employing the resulting toner which has been stored at high temperature and high humidity, or employing an image forming apparatus which has not been operated over an extended period of time, image problems, such as fogging due to the variation of charge amount and minute dots of dust do not occur. Further, in the present invention, since fine coloring agent particles are dispersed in the toner particle without using any media, image problems due to minute residual impurities such as crushed pieces of media in said toner do not occur.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Further, in the present invention, after preparing colored particles upon salting out, aggregating, and coalescing resin particles and colorants in a water based medium, separation of said toner particles from said water based medium is preferably carried out at a temperature of not lower than the Krafft point of the surface active agents in said water based medium, and is more preferably carried out in the range of said Krafft point to said Karfft point plus 20° C.

The Krafft point, as described herein, refers to the temperature at which an aqueous solution comprising a surface active agent starts to become milky-white. The Krafft point is measured as follows.

<<Measurement of Krafft Point>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

From the viewpoint of minimizing excessive static charge to toner particles and providing uniform static-charge buildup to said toner particles, particularly in order to stabilize static-charge buildup against ambience, as well as to maintain the resulting static-charge buildup, the electrostatic image developing toner of the present invention preferably comprises the aforesaid metal elements (listed as such forms are metals and metal ions) in an amount of 250 to 20,000 ppm in said toner and more preferably in an amount of 800 to 5,000 ppm.

Further, in the present invention, the total concentration of divalent (or trivalent) metal elements employed in coagulants and univalent metal elements added as coagulation inhibiting agents, described below, is preferably from 350 to 35,000 ppm. It is possible to obtain the residual amount of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

(Filtration and Washing Process)

In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like. Listed as diolefin based monomers are butadiene, isoprene, chloroprene, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its sodium salt, allylsulfo succinic acid, allylsulfo succinic acid octyl ester and their sodium salts.

(4) Monomer Having a Basic Polar Group

As the monomer having a basic polar group, can be cited (a) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (b) (meth)acrylic acid amide or (meth)acrylic acid amide having mono-alkyl group or di-alkyl group, having 1 to 18 carbon atoms, substituted on its N atom, (c) vinyl compound substituted with a heterocyclic group having at least a nitrogen atom in said heterocyclic group, (d) N,N-di-allyl-alkylamine or its quaternary salt. of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (a) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (b) include acrylamide, N-butylacrylamide, N,N-dibutylacrylamide, piperidylacrylamide, methacrylamide, N-butylmethacrlamide, N,N-dimethylacrylamide, N-octadecylacrylamide, etc.

Examples of vinyl compound substituted with a heterocyclic group having at least a nitrogen atom in said heterocyclic group of (c) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (d) include N,N-di-allyl-methylammonium chloride, N,N-di-allyl-ethylammonium chloride, etc.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like. Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at room temperature or higher.

(Chain Transfer Agents)

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservavability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapt group, a neopentyl glycol compound having mercapt group, and a pentaerythritol compound having mercapt group. Among them n-octyl-3-mercaptopropionic acid ester is preferable in view of minimizing smell at the time of thermal fixing.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

In the present invention, surface active agents represented by General Formulas (1) and (2) are most preferably employed.

$$R^1(OR^2)_nOSO_4M \qquad \text{General Formula (1)}$$

$$R^1(OR^2)_nSO_3M \qquad \text{General Formula (2)}$$

In General Formulas (1) and (2), $R^1$ represents an alkyl group having from 6 to 22 carbon atoms or an arylalkyl group. $R^1$ is preferably an alkyl group having from 8 to 20 carbon atoms or an arylalkyl group and is more preferably an alkyl group having from 9 to 16 carbon atoms or an arylalkyl group.

Listed as alkyl group having from 6 to 22 carbon atoms represented by $R^1$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ are a benzyl group, a diphenylmethyl group, a cinnamyl group, a styryl group, a trityl group, and a phenethyl group.

In General Formulas (1) and (2), $R^2$ represents an alkylene group having from 2 to 6 carbon atoms. $R^2$ is preferably an alkylene group having 2 or 3 carbon atoms. Listed as alkylene groups having from 2 to 6 carbon atoms represented $R^2$ are an ethylene group, a trimethylene group, a tetramethylene group, a propylene group, and an ethylethylene group.

In General Formulas (1) and (2), n represents an integer of 1 to 11; and n is preferably from 2 to 10, is more preferably from 2 to 5, and is most preferably 2 or 3.

In General Formulas (1) and (2), listed as univalent metal elements represented by M are sodium, potassium, and lithium. Of these, sodium is preferably employed.

Specific examples of surface active agents represented by General Formulas (1) and (2) are illustrated below:

Compound (101): $C_{10}H_{21}$ $(OCH_2CH_2)_2OSO_3Na$

Compound (102): $C_{10}H_{21}$ $(OCH_2CH_2)_3OSO_3Na$

Compound (103): $C_{10}H_{21}$ $(OCH_2CH_2)_2OS_3Na$

Compound (104): $C_{10}H_{21}$ $(OCH_2CH_2)_3OSO_3Na$

Compound (105): $C_8H_{17}$ $(OCH_2CH(CH_3))2OSO_3Na$

Compound (106): $C_{18}H_{37}$ $(OCH_2CH_2)_2OSO_3Na$

In the present invention, from the viewpoint of maintaining the electrostatic charge holding function of toner in the desired state, minimizing fogging at high temperature and high humidity, and improving transferability, as well as minimizing an increase in electrostatic charge at low temperature and low humidity, and stabilizing the development amount, the content of the surface active agents represented by the aforesaid General Formulas (1) and (2) in the electrostatic image developing toner is preferably from 1 to 1,000 ppm, is more preferably from 5 to 500 ppm, and is most preferably from 7 to 100 ppm.

In the present invention, by adjusting the amount of the surface active agents incorporated to said range, the static charge of the electrostatic image developing toner of the present invention is built up being independent of ambience, and can be uniformly and stably provided and maintained.

Further, the content of the surface active agents represented by the aforesaid General Formulas (1) and (2) is calculated employing the method described below.

One g of toner is dissolved in chloroform, and surface active agents are extracted from the chloroform layer employing 100 ml of deionized water. Further, said chloroform layer, which has been extracted, is further extracted employing 100 ml of deionized water, whereby 200 ml of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surface active agents in the toner is determined employing the independently prepared calibration curve.

Further, said extract is analyzed employing 1H-NMR, and the structure of the surface active agents represented by General Formulas (1) and (2) is determined.

The coagulants selected from metallic salts are preferably employed in the processes of salting-out, coagulation and fusion from the dispersion of resin particles prepared in t e aqueous medium. The two or three valent metal salt is preferable to monovalent metal salt because of low critical coagulation concentration (coagulation point).

A nonion surfactant may be employed in the invention. Practically, examples thereof include polyethyleneoxide, polypropireneoxide, combination of polyethyleneoxide and polypropireneoxide, ester of polyethyleneglicol and higher aliphatic acid, alkylphenol polyethyleneoxide, ester of higher aliphatic acid and polyethyleneglicol, ester of higher aliphatic acid and polypropireneoxide, and sorbitan ester.

The surface active agent is employed mainly as an emulsifier, and may be used for other purpose in the other process.

(Molecular Weight Distribution of the Resin Particle and Toner)

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF)

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulant)

The coagulants selected from metallic salts are preferably employed in the processes of salting-out, coagulation and fusion from the dispersion of resin particles prepared in t e aqueous medium. The two or three valent metal salt is preferable to monovalent metal salt because of low critical coagulation concentration (coagulation point).

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the $\zeta$ potential of the dispersion, and in addition the critical coagulation concentration may be obtained as the salt concentration which initiates a variation in the $\zeta$ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

<Colorants>

The toner is obtained by salting out/fusing the composite resin particles and colored particles.

Listed as colorants which constitute the toner of the present invention may be inorganic pigments, organic pigments, and dyes.

Employed as said inorganic pigments may be those conventionally known in the art. Specific inorganic pigments are listed. Employed as black pigments are, for example, carbon black such as furnace black, channel black, acetylene black, thermal black, lamp black, and the like, and in addition, magnetic powders such as magnetite, ferrite, and the like.

If required, these inorganic pigments may be employed individually or in combination of a plurality of these. Further, the added amount of said pigments is commonly between 2 and 20 percent by weight with respect to the polymer, and is preferably between 3 and 15 percent by weight.

Afore mentioned magnetite can be employed when the toner is employed as a single component toner. In this instance incorporate amount is preferably 20 to 60% by weight in view of giving predetermined magnetic characteristics.

Employed as said organic pigments and dyes may be those conventionally known in the art. The colorant in wet paste state is effectively employed to demonstrate the effect of the invention as stated above. Specific organic pigments are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 156, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, C.I. Solvent Red 59, C.I. Solvent Red 52, C.I. Solvent Red 58, C.I. Solvent Red 63, C.I. Solvent Red 111, C.I. Solvent Red 122; C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, Solvent Yellow 162; C.I. Solvent Blue 25, C.I. Solvent Blue 36, C.I. Solvent Blue 60, C.I. Solvent Blue 70, C.I. Solvent Blue 93, and C.I. Solvent Blue 95. Further these may be employed in combination.

If required, these organic pigments, as well as dyes, may be employed individually or in combination of selected ones. Further, the added amount of pigments is commonly between 2 and 20 percent by weight, and is preferably between 3 and 15 percent by weight.

(Crystalline Materials)

Toner employed in the invention is preferably prepared by fusing resin particles containing a crystalline material and colored particles in water based medium and then digesting the obtained particles whereby the crystalline material and the colorant are dispersed in resin matrix adequately to form a domain-matrix structure. The digestion is a process subjecting the fused particles to continuing agitation at a temperature of melting point of the crystalline material plus minus 20 centigrade.

Preferable examples of the crystalline material having releasing property include low molecular weight polypropylene having average molecular weight of 1,500 to 9,000 and low molecular weight polyethylene, and a particularly preferable example is an ester compounds represented by General Formula (1), described below.

$$R^1—(OCO—R^2)_n \quad (1):$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

16) $CH_3—(CH_2)_{26}—COO—CH_2—C(CH_3)(CH_2—O—CO—(CH_2)_{26}—CH_3)—CH_2—O—CO—(CH_2)_{26}—CH_3$

17) $CH_3—(CH_2)_{20}—COO—CH_2—C(CH_2CH_3)(CH_2—O—CO—(CH_2)_{20}—CH_3)—CH_2—O—CO—(CH_2)_{20}—CH_3$

18) $CH_3—(CH_2)_{26}—COO—CH_2—C(CH_2—O—CO—(CH_2)_{26}—CH_3)_2—CH_2—O—CO—(CH_2)_{26}—CH_3$

-continued

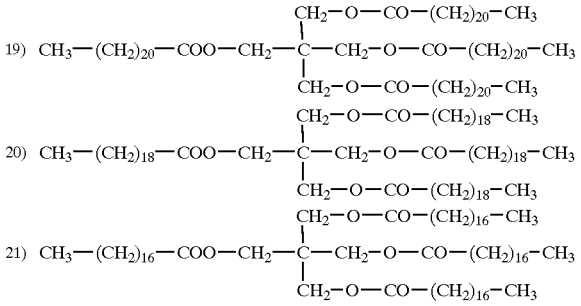

As a compound constituting crystalline polyester obtained by reaction of aliphatic diol with an aliphatic dicarboxylic acid (acid anhydride and acid chloride are included) is preferable.

Example of the diol which is used in order to obtain crystalline polyester includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconate, n-dodecyl succinic acid, n-dodecenyl succinic acid, iso dodecyl succinic acid, iso dodecenyl succinic acid, n-octyl succinic acid, n-oxotenyl succinic acid, and these acid anhydride or an acid chloride can be mentioned.

In particular as a preferable crystalline polyester compound, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylene glycol and succinic acid, polyester obtained by reacting ethylene glycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

As a containing ratio of the compound in the toner, it is preferable that crystalline polyester is from 1 to 30 percent by weight, and more preferably from 2 to 20 percent by weight, and in particular from 3 to 15 percent by weight of toner weight as a whole.

<Developers>

The toner of the present invention may be employed in either a single-component developer or a two-component developer. Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

The image forming apparatus, which employs the image forming method using the toner of the present invention, will now be described.

In the present invention, a photoreceptor is charged and an image is exposed. Subsequently, a toner image, which is formed by developing the resultant electrostatic latent image employing a developer, is transferred onto a transfer material employing a contact transfer system. Thereafter, the resultant toner image is separated from said photoreceptor and fixed. Said photoreceptor is then cleaned. Said processes are repeated so that a number of images on many sheets are formed.

(Transfer Roller)

The transfer of said toner image from the surface of said photoreceptor to said transfer material is carried out by pushing an elastic transfer roller onto said photoreceptor under the application of voltage. Employed as said transfer rollers are elastic materials comprised of rubber or porous foamed materials. Listed as such are various types of transfer rollers such as (1) ion conductive type manufactured by Bridgestone Co., (2) electronic conductive type manufactured by Bridgestone Co., (3) foamed urethane Rubicel type manufactured by Toyo Polymer Co., (4) ion conductive type manufactured by Sumitomo Gomu Kogyo Co., (5) EPDM type manufactured by Sumitomo Gomu Kogyo Co., (6) epichlorohydrin type manufactured by Sumitomo Gomu Kogyo Co., (7) ENDUR ion conductive type manufactured by Inoac Corp., (8) formed silicone type manufactured by Tigers Polymer Co., (9) foamed urethane type manufactured by Hokushin Kogyo Co., (10) foamed silicone type manufactured by Shin-Etsu Polymer Co., and (11) carbon black containing foamed Rubicel type, and formed types are preferred.

In the image forming method employed in the present invention, in order to optimally transfer a toner image on the surface of the photoreceptor, pressure applied to said transfer roller against the photoreceptor is preferably from 2.5 to 100 kPa, and is more preferably from 10 to 80 kPa.

When said pressure ranges from 2.5 to 100 kPa, toner images are sufficiently transferred. In addition, the transfer of crystalline materials, having releasability in the toner, to the surface of the photoreceptor can be minimized, whereby it is possible to minimize the formation of image problems. Further, impact during releasing of pressure applied to the transfer roller is minimized, whereby it is possible to minimize image problems due to transfer deviation, as well as damage of the photoreceptor.

Further, important characteristics required for said transfer roller include, for example, modulus of repulsion elasticity, electric resistance, and surface hardness. Said modulus of repulsion elasticity of elastic materials of said transfer roller is preferably from 30 to 70 percent. When said modulus of repulsion elasticity is from 30 to 70 percent, a sufficient force onto the photoreceptor for the transfer of toner images is obtained, whereby the desired transfer ratio is obtained. Further, since impact during the transfer is decreased, image problems such as transfer deviation can be minimized. Incidentally, said modulus of repulsion elasticity is measured employing the method specified in JIS K 7311.

Further, said transfer roller is required to be suitably electrically conductive so that it can be applied by bias voltage. The electric resistance of said transfer roller, when measured employing the method described below, is preferably from $1\times10^3$ to $1\times10^{13}$ Ω.

Measurement Method

A transfer roller prepared by providing a 4 mm thick elastic material onto a 16 mm diameter and 310 mm long rotation shaft is brought into pressure contact with a 30 mm diameter aluminum pipe at a force of 17 kPa. At an ambience of 20° C. and 50 percent relative humidity, electric resistance between said rotation shaft of the transfer roller and said aluminum pipe is measured.

Further, the surface hardness of said elastic material, when measured employing an Asker C hardness tester, is preferably from 20 to 70 degrees. A transfer roller comprised of elastic materials, having an Asker C harness of 20 to 70 degrees, is preferred because optimal transfer is carried out and image problems, such as transfer deviation, do not occur.

The image forming apparatus, utilizing the image forming method of the present invention, which forms images on many sheets, will now be described. Incidentally, "the image forming method of the present invention which forms images on many sheets", as described herein, refers to the image forming method which forms images on many sheet as follows. A photoreceptor is charged and an image is exposed. Subsequently, a toner image, which is formed by developing the resultant electrostatic latent image employing a developer, is transferred onto a transfer material employing a contact transfer system. Thereafter, the resultant toner image is separated from said photoreceptor and fixed. Said photoreceptor is then cleaned. Said processes are repeated so that images on many sheets are formed.

Figure 4:
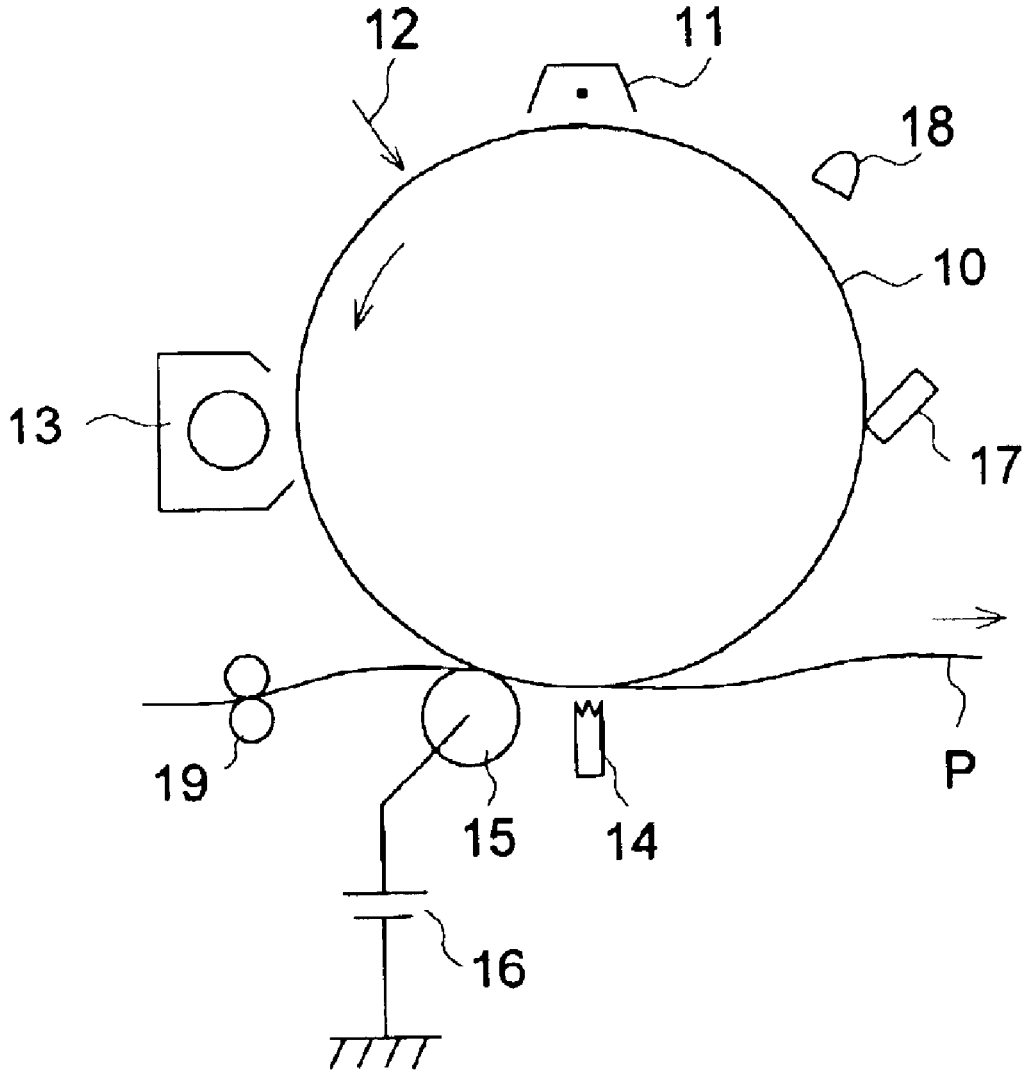
FIG. 4 is a schematic view of a configuration showing one example of an image forming apparatus utilizing a transfer roller applied to the present invention.

FIG. 4 is a schematic view of a configuration showing one example of an image forming apparatus utilizing said transfer roller. In FIG. 4, photoreceptor 10 is an organic photoreceptor which rotates in the arrowed direction, numeral 11 is a charging unit which results in uniform charge onto said photoreceptor, and said charging unit may be a corona charging unit, a roller charging unit, or a magnetic brush charging unit. Numeral 12 is digital image exposure light utilizing semiconductor laser or light-emitting diodes. An electrostatic latent image is formed on said photoreceptor employing said image exposure light. Said electrostatic latent image is developed under contact or non-contact, employing development unit 13 which stores developer comprising a toner, having a volume average particle diameter of 3 to 9 μm, and a toner image is formed on said photoreceptor. Incidentally, in the present invention, said exposure is preferably a digital image exposure, but analogue image exposure may also be employed.

Said image forming method as well as said apparatus utilizes a computer or a device which carries out light modulation, employing an acoustic optical modulator provided in a laser optical system as a scanning optical system which carries out light modulation employing digital image signals from an original document for copying, or a device which directly modulates the intensity of a laser, employing a semiconductor laser. From any of these scanning optical systems, spot exposure is carried out onto a uniformly charged photoreceptor, whereby dot images are formed.

A beam irradiated from said scanning optical system results in circular or elliptical luminance distribution similar to the normal distribution. For example, a laser beam results in a markedly narrow circular or elliptical spot of 20 to 100 μm on the photoreceptor in the primary scanning direction, in the secondary scanning direction, or in both directions.

Said toner image is transferred onto transfer material P, which is timely conveyed, employing transfer roller 15 under bias voltage application as well as a pressure of 2.5 to 100 kPa, and more preferably from 10 to 80 kPa.

Direct current bias power source 16, which applies bias voltage to said transfer roller 15, is preferably a constant current power source or a constant voltage power source. Said constant current power source supplies 5 to 15 μA, while said constant voltage power source supplies 400 to 1,500 V in terms of absolute value. Further, transfer material P, which has been subjected to image transfer employing said transfer roller 15, is separated from photoreceptor 10, employing separation electrode 10, is conveyed to a fixing unit (not shown), and is then heat-fixed.

The photoreceptor surface after transfer is cleaned employing cleaning blade 17, and subsequently, is subjected to charge elimination, employing charge elimination lamp (PCL) 18, and is prepared for the next image formation. Incidentally, numeral 19 is a paper feeding roller and 20 is a fixing unit.

(Intermediate Transfer Body)

In the present invention, the transfer of toner images from a photoreceptor to a transfer material may be carried out by a system utilizing an intermediate transfer body. Namely, said intermediate transfer body may preferably be employed in the color image forming system described below. An image forming section (an image forming unit) of one of 4 color developers is provided, and in each image forming section, each visible color image is formed on each photoreceptor. The resultant visible images are successively transferred onto an intermediate transfer body, and subsequently, are simultaneously transferred onto a transfer material (commonly plain paper, however including any transferable materials, and in the present invention, sheets for overhead projectors are particularly preferred), and thereafter, is fixed to prepare color images.

Figure 5:
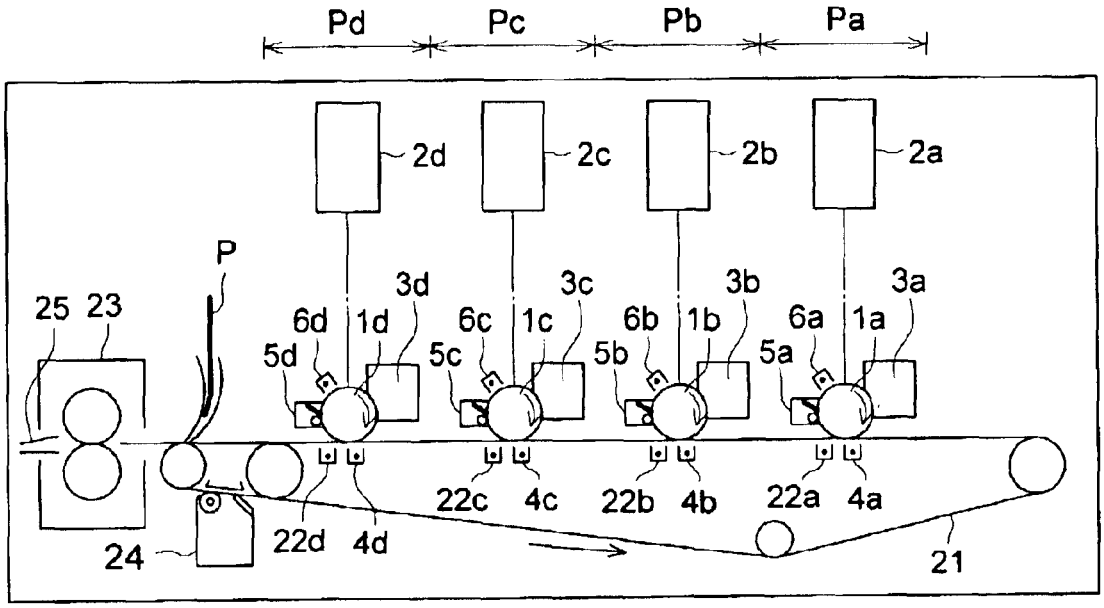
FIG. 5 is a schematic view of a configuration of one example of an image forming apparatus employing a transfer belt applied to the present invention.

An image forming method, in which a plurality of color images employed in the image forming apparatus of the present invention is formed in the image forming section, and the resultant color images are superposed onto the same intermediate transfer body, and then transferred, will now be described with reference to a drawing. FIG. 5 is a schematic view of a configuration of one example of an image forming apparatus employing an intermediate transfer body (a transfer belt).

In FIG. 5, the image forming apparatus to prepare color images is provided with a plurality of image forming units. In each image forming unit, a different color visual image (a toner image) is formed and said toner image is successively superposed onto the same intermediate transfer body, and then transferred.

Herein, first image forming unit Pa, second image forming unit Pb, third image forming unit Pc, and fourth image forming unit Pd are arranged in series. Each of said image forming sections is provided with each of photoreceptor 1*a*, 1*b*, 1*c*, and 1*d*, each of which is an electrostatic latent image forming body. Around each of photoreceptors 1*a*, 1*b*, 1*c*, and 1*d* are provided each of latent image forming sections 2*a*, 2*b*, 2*c*, and 2*d*, each of development sections 3*a*, 3*b*, 3*c*, and 3*d*, each of transfer discharge section 4*a*, 4*b*, 4*c*, and 4*d*, each of cleaning units 5*a*, 5*b*, 5*c*, and 5*d* comprising a cleaning member as well as a rubber blade, and each of charging units 6*a*, 6*b*, 6*c*, and 6*d*.

In said constitution, initially, for example, the yellow color component image of an original document is formed on photoreceptor 1*a* of first image forming unit Pa, employing latent image forming section 2*a*. Said latent image is developed to form a visible image, employing a developer comprising a yellow toner of development section 3*a*, and the developed image is transferred onto transfer belt 21 at transfer discharge section 4*a*.

On the other hand, while said yellow toner image is transferred onto transfer belt 21, as described above, in second image forming unit Pb, a magenta color component latent image is formed on photoreceptor 1*b*, and subsequently is developed, employing a developer comprising a magenta toner in development section 3*b*, whereby a visual image is formed. Said visible image (a magenta toner image) is transfer-superposed on the specified position of said transfer belt 21 when said transfer belt, which has been subjected to transfer in said first image forming unit Pa, is conveyed to transfer discharge section 4*b*.

Subsequently, the image formation of a cyan component as well as a black component is carried out in the same manner as the method described above, employing third image forming unit Pc and fourth image forming unit Pd. As a result, on said transfer belt, the cyan toner image and the black toner image are superpose-transferred. When said image transfer is finished, a superposed multicolor image is prepared on said transfer belt 21. On the other hand, photoreceptors 1*a*, 1*b*, 1*c*, and 1*d*, which have finished the transfer, are subjected to removal of any residual toner, employing cleaning units 5*a*, 5*b*, 5*c*, and 5*d*, and are then employed to form the next image formation.

Incidentally, in said image forming apparatus, transfer belt 21 is employed. In FIG. 5, said transfer belt 21 is conveyed from right to left. During said conveyance process, said transfer belt 21 passes through each of transfer discharge sections 4*a*, 4*b*, 4*c*, and 4*d* in each of image forming units Pa, Pb, Pc, and Pd, and each color image is transferred.

When transfer belt 21 passes through fourth image forming unit Pd., an AC voltage is applied to separation charge eliminating unit 22*d*, and said transfer belt 21 is subjected to charge elimination, whereby all toner images are simultaneously transferred onto transfer material P.

Incidentally, in FIG. 5, 22*a*, 22*b*, 22*c*, and 22*d* each are a separation charge elimination discharging unit, respectively. Transfer belt 21, which has finished the transfer of toner images, is subjected to removal of the residual toner, employing cleaning unit 24 comprised of a brush type cleaning member in combination with a rubber blade, and is prepared for the next image formation.

Further, as described above, a multicolor superposed image is formed on transfer belt 21 such as a long conveying belt, and the resultant image is simultaneously be transferred onto a transfer material. Alternatively, it may be constituted in such a manner that an independent transfer belt is provided to each of the image forming units, and an image is successively transferred to a transfer material from said each transfer belt.

Further, employed as said transfer belt is a looped film which is prepared as described below. A 5 to 15 $\mu$m thick releasing type layer, the surface resistance of which is adjusted to $10^5$ to $10^8$ Ω by adding conductive agents to a fluorine based or silicone based resin, is provided onto an approximately 20 $\mu$m thick high-resistance film comprised of polyether, polyamide or tetrafluoroethylene-perfluorovinyl ether, having a surface resistance of greater than or equal to $10^{14}$ Ω.

In the image forming method of the present invention, as described above, a toner image formed in the development process passes through a transfer process in which said image is transferred onto a transfer material. Subsequently, the transferred image is fixed in a fixing process. Listed as the suitable fixing method employed in the present invention may be a so-called contact heating system. Particularly listed as said contact heating system are a heat pressure fixing system, and further, a heating roller fixing system, as well as a pressure contact heating fixing system in which fixing is carried out employing a rotating pressing member which includes in its interior a fixedly installed heating body.

Said heating roller fixing system is constituted of an upper roller and a lower roller. Said upper roller is formed by covering, with tetrafluoroethylene or polytetrafluoroethylene-perfluoroalkoxyvinyl ether copolymers, the surface of a metal cylinder comprised of iron or aluminum, which has a heating source in its interior, and said lower roller is formed employing silicone rubber. The representative example of said heating source is one having a linear heater which heats the surface of said upper roller to about 120 to 200° C. Pressure between said upper roller and said lower roller is applied in the fixing section and a so-called nip is formed by deformation of said lower roller. The resultant nip width is commonly from 1 to 10 mm, and is preferably from 1.5 to 7 mm. The linear fixing velocity is preferably from 40 to 600 mm/second. When said nip width is less than said lower limit, it becomes difficult to uniformly provide heat to a toner, whereby uneven fixing occurs. On the other hand, when said nip width is greater than said upper limit, problems with excessive off-setting during fixing occur due to the enhancement of melting resins.

A fixing-cleaning mechanism may be provided. Employed as systems to achieve said mechanism may be a system in which silicone oil is supplied onto the upper fixing roller or film, and a system in which cleaning is carried out utilizing a pad, a roller, or a web each of which are impregnated with silicone oil.

The fixing system employed in the present invention will now be described in which fixing is carried out employing a rotating pressing member which includes a fixedly installed heating body.

Said fixing system is a pressure contact heating fixing system which is comprised of a fixedly installed heating body and a pressing member which is brought into pressure contact with said heating body, so as to face it, and which makes a transfer material come into close contact with said heating body via a film.

A unit, which carries out said pressure contact heating fixing system, is the unit which comprises a heating body having less heat capacity than that employed in conventional heating rollers and also has a linear heating section perpendicular to the passing direction of the transfer material. The maximum temperature range of said heating section is commonly from 100 to 300° C.

Further, the pressure contact heating fixing system, as described herein, refers to a method in which fixing is carried out by bringing an unfixed toner image into pressure contact with a heating source, in the same manner as systems in which a transfer material having an non-fixed toner is passed between a heating member and a pressure member. By utilizing said arrangement, heating is carried out quickly. As a result, it is possible to carry out fixing at a high rate. However, said system results in problems as described below. Since it is difficult to control temperature, so-called off-setting tends to occur due to the fact that toner adheres to and remains on the part with which an unfixed toner directly comes into pressure contact with, such as the surface of the heating source. In addition, the transfer material tends to be wound into the fixing unit.

In said fixing system, said low heat capacity linear heating body, which is fixedly installed in the fixing unit, is prepared as described below. A resistive material is applied onto an alumina substrate at a thickness of 1.0 to 2.5 mm, having a thickness of preferably from 0.2 to 5.0 mm, and more preferably from 0.5 to 3.5 mm, a width of 10 to 15 mm, and a length of 240 to 400 mm. An electric current is supplied from both ends.

An electric current is supplied in a pulse shape having a cycle of 15 to 25 milliseconds of DC 100 V, while varying the pulse width, corresponding to a temperature-energy emission amount, controlled by a temperature sensor. In said low heat capacity linear heating body, when T1 is the temperature detected by said temperature sensor, T2, which is the surface temperature of the film, facing the resistive material, becomes less than T1. Herein, T1 is preferably from 120 to 220° C., and T2 is preferably 0.5 to 10° C. lower than T2. Further, T3, which is the surface temperature of the film material in the area in which a film is peeled off from the surface of a toner particle, is almost equal to T2. Said film comes into contact with the heating body which is subjected to energy control and temperature control as described above, and is conveyed in the arrowed direction in the center of FIG. 6(*a*). The film, which is employed for said fixing, is a heat resistant 10 to 35 $\mu$m thick looped film, which is comprised of, for example, polyester, polyperfluoroalkoxyvinyl ether, polyimide, or polyether imide. In many cases, said film is a looped film which is prepared by covering a conductive material-incorporated fluorine resin such as Teflon with a 5 to 15 $\mu$m thick releasing agent layer.

Said film is subjected to a driving force and tension utilizing a driving roller as well as a driven roller and is conveyed in the arrowed direction without causing wrinkles or creases. The linear velocity of the fixing unit is preferably from 230 to 900 nm/second.

Said pressure roller comprises an elastic rubber layer comprised of silicone rubber, exhibiting high releasability. It comes into pressure contact with said heating body via said film material and rotates under pressure contact.

Further, in the foregoing, the example utilizing the looped film has been described. However, as shown in FIG. 6(*b*), by employing the feed-out shaft and the winding shaft, a film with both ends may also be used. In addition, a cylinder shaped film may be employed which has no driving rollers in its interior.

Said cleaning unit may be employed, being provided with a cleaning mechanism. Employed as cleaning systems are a system in which various types of silicone oils are supplied to fixing films, as well as a system in which cleaning is carried out employing a pad, a roller, or a web impregnated with various types of silicone oils.

Incidentally, employed as silicone oils may be polydimethylsiloxane, polyphenylsiloxane, or polydiphenylsiloxane. Further, siloxane containing fluorine may suitably be employed.

FIG. 6(*a*) shows an example of the cross-sectional view of the configuration of said fixing unit.

In FIG. 6(*a*), as one example, numeral 84 is a low heat capacity linear heating body which has been prepared by applying 1.0 mm wide resistive material 86 onto alumina substrate 85 having a height of 1.0 mm, a width of 10 mm, and length of 240 mm. An electric current is supplied from both ends in the longitudinal direction.

For example, an electric current is supplied commonly in a pulse shape having a cycle of 20 milliseconds of DC 100 V, and said heating body is maintained at the specified temperature while controlled by employing signals from a temperature detecting element. In order to achieve this, the pulse width is varied, for example, from 0.5 to 5 milliseconds corresponding to the amount of energy emission. Transfer material 94, bearing unfixed toner image 93, comes into contact with heating body 84 via moving film 88, whereby the toner is heat-fixed.

Film 88, employed herein, is conveyed without causing wrinkling under tension applied by driving roller 89 as well as with driven roller 90. Numeral 95 is a pressure roller comprising an elastic rubber layer formed employing silicone rubber, and the like, and presses said heating body via said film under a total pressure of 0.4 to 2.0 N. Unfixed toner image 93 on transfer material 94 is led to a fixing section through inlet guide 96 and fixed images are prepared by the heating described above.

In the foregoing, a case, in which the looped film is employed, has been described. However, as shown in FIG. 6(*b*), a fixing film with both ends may be usable while employing film sheet feed-out shaft 91 as well as winding shaft 92.

Further, the image forming apparatus, employed in the present invention, may have a mechanism which carries out toner recycling in which a non-transferred toner, which remains on the surface of the photoreceptor, is subjected to recycling. Listed as systems to carry out toner recycling may be, for example, a method in which toner, recovered in the cleaning section, is conveyed employing a conveyer or a conveying screw to a hopper for supplying the toner or a development unit, or is mixed with supply toner in an intermediate chamber and is then supplied to the development unit. Listed as preferred systems may be a system in which recovered toner is directly returned to the development unit, or a system in which recycled toner is mixed with supply toner in the intermediate chamber and is then supplied.

Figure 7:
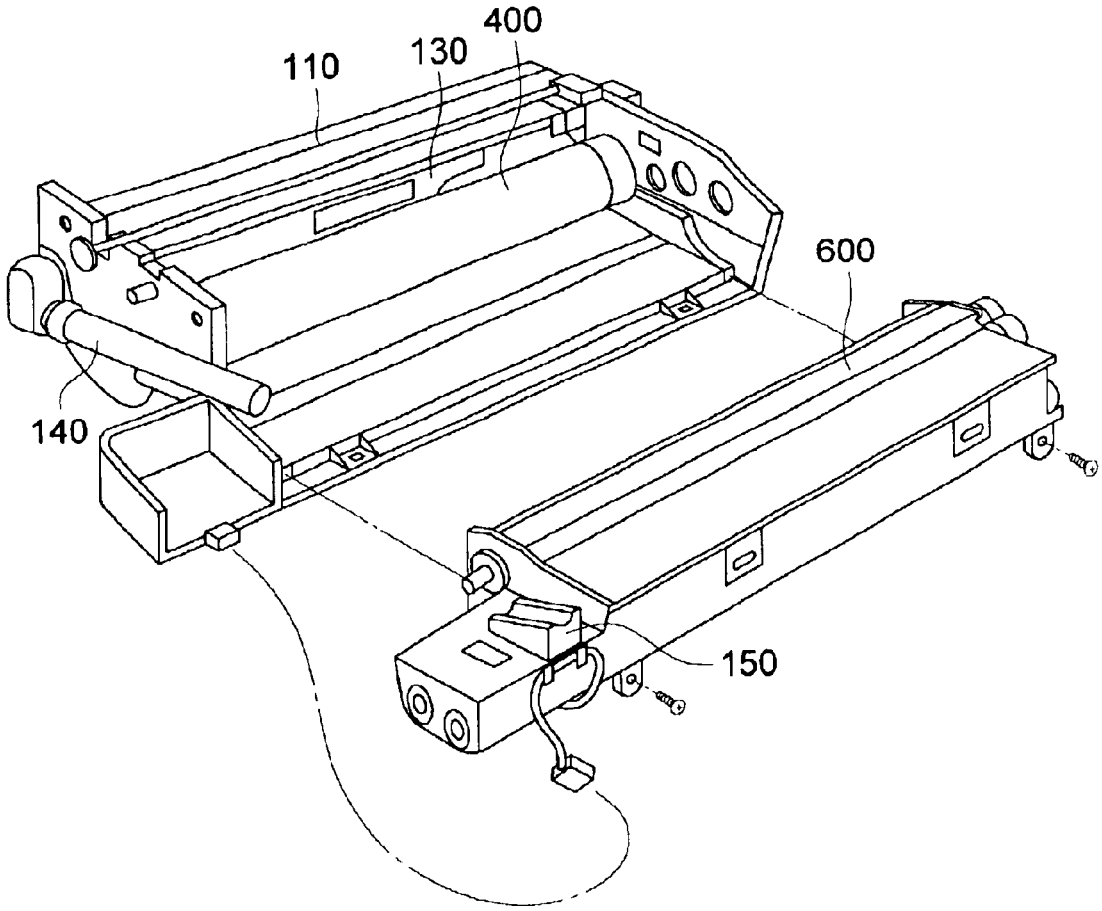
FIG. 7 is a perspective view of a configuration of a toner recycling member.

In FIG. 7, one example of the perspective view of a toner recycling member is illustrated. Said system is the system in which recycled toner is returned directly to the development unit.

Any non-transferred toner, which has been recovered utilizing cleaning blade 130, is collected in toner recycling pipe 140, and is then returned to development unit 600 from inlet 150 of said recycling pipe so as to be repeatedly used as a developer.

FIG. 7 also is a perspective view of a detachable processing cartridge which is installed in the image forming apparatus of the present invention. In FIG. 7, in order to make the perspective structure clearer, the photoreceptor unit is shown separated from the developer unit. However, these may be integrated into one unit and may be detachably installed in said image forming apparatus. In this case, the photoreceptor, the development unit, the cleaning unit, and the recycling member are integrated so as to constitute said processing cartridge.

EXAMPLES

The present inventing will now be detailed with reference to examples. The term "part(s)" denotes part(s) by weight.

Preparation Example of Resin for Toner

Preparation of Latex 1HML (1) Preparation of Core Particle (The First Stage Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (101) in 3,010 g of deionized water, and the interior temperature was raised to 80° C. under a nitrogen gas flow while stirring at 230 rpm.

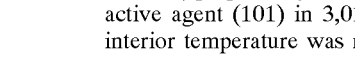

$$C_{10}H_{21}(OCH_2CH_2)_2OSO_4Na \quad (101)$$

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resin particles) was obtained. The resulting latex was designated as Latex (1H).

(2) Forming an Inter Layer (The Second Stage Polymerization)

A monomer solution was prepared in such way that 98.0 g of Exemplified Compound 19) was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90° C. to dissolve the monomers in a flask equipped with a stirrer.

(2) Forming an Inter Layer

A monomer solution was prepared in such way that 98.0 g of Exemplified Compound 19) was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90° C. to dissolve the monomers in a flask equipped with a stirrer.

Surfactant solution containing 1.6 g of anionic surfactant (101) dissolved in 2,700 ml of deionized water was heated to 98° C. To the surfactant solution 28 g (converted in solid content) the latex 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion (emulsion) containing dispersion particles (oil droplet) having dispersion particle diameter of 284 nm was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resin particles which are composed of resin particles having higher molecular weight polymer resin covered with a middle molecular weight polymer) was obtained (a second stage polymerization). The resulting latex was designated as Latex (1HM).

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resin particles which are composed of resin particles having higher molecular weight polymer resin covered with a middle molecular weight polymer) was obtained (a second stage polymerization). The resulting latex was designated as Latex (1HM).

Particles having diameter of 400 to 2,000 nm composed of mainly Exemplified Compound 19), which is not incorporated in the latex particles, are observed in the dried the Latex 1HM by scanning electron microscope.

(3) Forming Outer Layer (The Third Stage Polymerization)

Polymerization initiator solution containing 7.4 g of polymerization initiator KPS dissolved in 200 ml deionized water was added to the latex 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C. The mixture underwent polymerization by stirring with heating for 2 hours (a third stage polymerization), it was cooled to 28° C. Thus Latex 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained.

The polymers composed of composite resin particles composing the latex 1HML have peaks at molecular weight of 138,000, 80,000 and 13,000, and weight average particular size of the composite resin particles was 122 nm.

Latex 2L

Initiator solution containing 14.8 g of polymerization initiator (KPS) dissolved in 400 ml of deionized water was prepared in a flask equipped with a stirrer. A monomer mixture solution consisting of 600 g of styrene, 190 g of n-butylacrylate, 30.0 g of methacrylic acid, and 20.8 g of n-octyl-3-mercaptoprpionic ester was added dropwise over 1 hour at temperature of 80° C. The mixture underwent polymerization by stirring with heating for 2 hours, it was cooled to 27° C. Thus latex, dispersion composed of resin particles of lower molecular weight polymer resin obtained. The resulting latex was designated as Latex (2L).

The polymer composed of Latex 2L has peaks at molecular weight of 11,000, and weight average molecular weight of the composite resin particles was 128 nm.

Preparation Example of Toner Particles 1Bk Through 9Bk and Comparative Toner Particles 1Bk, 2Bk and 4Bk Added to 1600 ml of deionized water were 59.0 g of anionic surfactant (101) which were stirred and dissolved. While stirring the resulting solution, 420.0 g of carbon black, "Regal 330" (produced by Cabot Corp.), were gradually added, and subsequently dispersed employing a stirring unit, "Clearmix" (produced by M Technique Ltd.) shown by FIG. 3(*b*). Thus a colorant particle dispersion (hereinafter referred to as "Colorant Dispersion (Bk)") was prepared. The colorant particle diameter of said Colorant Dispersion (Bk) was determined employing an electrophoresis light scattering photometer "ELS-800" (produced by Ohtsuka Denshi Co.), resulting in a weight average particle diameter measurement of 90 nm.

Placed into a four-necked flask fitted with a temperature sensor, a cooling pipe, a nitrogen gas inlet unit, and a stirring unit were 420.7 g (converted in solid content) of Latex (1HML) obtained in Preparation Example 1, 900 g of deionized water, and 166 g of Colorant Dispersion (Bk) prepared as previously described, and the resulting mixture was stirred. After adjusting the interior temperature to 30° C., 5N aqueous sodium hydroxide solution was added to the resulting solution, and the pH was adjusted to 11.0.

Subsequently, an aqueous solution prepared by dissolving 12.1 g of magnesium chloride tetrahydrate in 1,000 ml of deionized water was added at 30° C. over 10 minutes. After setting the resulting mixture aside for 3 minutes, it was heated so that the temperature was increased to 90° C. over 60 minutes. While maintaining the resulting state, the diameter of coalesced particles was measured employing a "Coulter Counter TA-II". When the volume average particle diameter reached 4 to 7 μm, the growth of particles was terminated by the addition of an aqueous solution prepared by dissolving 40.2 g of sodium chloride in 1000 ml of deionized water, and further fusion was continually carried out at a liquid media temperature of 98° C. for 6 hours, while being heated and stirred.

Resin particles dispersion Latex 2L in an amount of 96 g was added and stirring was continued for 3 hours so that the latex 2L was fused on the surface of coalesced latex (1HML). Thereafter, 40.2 g of sodium chloride was added, and the temperature was decreased to 30° C. at a rate of 8° C./minute. Subsequently, the pH was adjusted to 2.0, and stirring was terminated. The resulting coalesced particles were collected through filtration, and repeatedly washed with deionized water at 45° C. Washed particles were then dried by 40° C. air, and thus toner particles were obtained.

Toner particles 1Bk through 9Bk and Comparative toner particles 1Bk, 2Bk and 4Bk having characteristics of dispersion state, shape, particle size distribution and domain-matrix structure respectively shown in Tables 1 and 2, were obtained by controlling the dispersion property, shape and variation coefficient of shape of crystalline material and colorant, by varying pH during coagulation process, temperature, time and agitation strength of digestion process, and further by classification in liquid.

Preparation Example of Toner Particle 10Bk and Comparative Toner Particle 3Bk Toner particle 10Bk and Comparative toner particle 3Bk were prepared in the same way as the Toner particles 1Bk through 9Bk and the Comparative toner particles 1Bk, 2Bk and 4Bk except that the latex 2L was not added.

Preparation of Toner Particles 1Y Through 9Y and Comparative Toner Particles 1Y, 2Y and 4Y Added to 1600 ml of deionized water were 90 g of anionic surfactant (101) which were stirred and dissolved. While stirring the resulting solution, 420 g of dye, "C.I. Solvent Yellow 93" was gradually added, and subsequently dispersed employing a stirring unit, "Clearmix" (produced by M Technique Ltd.). Thus a colorant particle dispersion (hereinafter referred to as "Colorant Dispersion (Y)") was prepared. The colorant particle diameter of said Colorant Dispersion (Y) was determined employing an electrophoresis light scattering photometer "ELS-800" (produced by Ohtsuka Denshi Co.), resulting in a weight average particle diameter measurement of 250 nm.

Toner particles were obtained by the same way as the Toner particles 1Bk through 9Bk and the Comparative toner particles 1Bk, 2Bk and 4Bk except that 168 g of Colorant Dispersion (Y) was employed in place of 200 g of Colorant Dispersion (Bk). The toner particles thus obtained were designated as Toner particles 1Y through 9Y and Comparative toner particles 1Y, 2Y and 4Y.

Preparation of Toner Particle 10Y and Comparative Toner Particle 3Y

Toner particle 10Y and Comparative toner particle 3Y were prepared in the same way as the Toner particles 1Y through 9Y and the Comparative toner particles 1Y, 2Y and 4Y except that the latex 2L was not added.

Preparation of Toner Particles 11Y, 12Y and 13Y

Toner particles 11Y, 12Y and 13Y were prepared in the same way as the Toner particles 1Y through 9Y and the Comparative toner particles 1Y, 2Y and 4Y except that the colorant dispersion prepared by the following way was employed.

The colorant dispersion for the Toner particle 11Y was prepared by following way. Dimethylformamide 120 parts by weight was dispersed by a DISPER and a mixture of the dispersed solvent and 2 weight by parts of wet paste of C.I. Solvent Yellow 93 (content ratio of the colorant 35 weight by parts) was placed into a vessel which can be undergone vacuum evaporation. The mixture was heated at from 100 to 120° C. with reducing pressure to not more than 50 Torr by an aspirator so that water contained in the vessel was removed by evaporation as little as possible and the temperature was controlled at 120° C. Then 2 parts by weight of sulfonation agent chlorosulfuric acid was added, and reaction was made for 5 hours with stirring, and after the completion of the reaction, the surface treated C.I. Solvent Yellow 93 was washed several times with solvent in excess amount, was poured into water, and wet colorant paste of surface treated C.I. Solvent Yellow 93, containing 31% colorant by weight, was obtained by filtration. The wet colorant paste of C.I. Solvent Yellow 93, containing 31% colorant by weight, in an amount of 3.38 kg was gradually added into a solution obtained by stirring 10.0 L of deionized water and 0.90 kg of sodium n-dodecylsulfate, and they were subjected to dispersion process for 60 minutes continuously by CLEARMIX after stirring well for one hour. Thus the colorant dispersion for the Toner particle 11Y.

The colorant dispersion for the Toner particle 12Y was prepared by following way. Into 10.0 L of deionized water 0.90 kg of sodium n-dodecylsulfate was added and stirred. Into the solution 1.44 kg of wet colorant paste of C.I. Solvent Yellow 93, containing 73% colorant by weight, which was not surface treated, was added gradually and stirred well for one hour, then the mixture was dispersed for 60 minutes continuously by CLEARMIX shown by FIG. 3(*b*).

The colorant dispersion for the Toner particle 13Y was prepared by following way. Into 10.0 L of deionized water 0.90 kg of sodium n-dodecylsulfate was added and stirred. Into the solution 7.00 kg of wet colorant paste of C.I. Solvent Yellow 93, containing 15% colorant by weight, which was not surface treated, was added gradually and stirred well for one hour, then the mixture was dispersed for 60 minutes continuously by CLEARMIX shown by FIG. 3(*b*).

Preparation Example of Toner Particles 1M Through 9M and Comparative Toner Particles 1M, 2M and 4M Added to 1600 ml of deionized water were 90 g of anionic surfactant (101) which were stirred and dissolved. While stirring the resulting solution, 420 g of pigment, (C.I. Pigment Red 122), were gradually added, and subsequently dispersed employing a stirring unit, "Clearmix" (produced by M Technique Ltd.). Thus a colorant particle dispersion (hereinafter referred to as "Colorant Dispersion (M)") was prepared. The colorant particle diameter of said Colorant Dispersion (M) was determined employing an electrophoresis light scattering photometer "ELS-800" (produced by Ohtsuka Denshi Co.), resulting in a weight average particle diameter measurement of 250 nm.

Toner particles were obtained by the same way as the Toner particles 1Bk through 9Bk and the Comparative toner particles 1Bk, 2Bk and 4Bk except that 168 g of Colorant Dispersion (M) was employed in place of 200 g of Colorant Dispersion (Bk). The toner particles thus obtained were designated as Toner particles 1M through 9M and Comparative toner particles 1M, 2M and 4M.

Preparation of Toner Particle 10M and Comparative Toner Particle 3M

Toner particle 10M and Comparative toner particle 3M were prepared in the same way as the Toner particles 1M through 9 M and the Comparative toner particles 1M, 2M and 4M except that the latex 2L was not added.

Preparation of Toner Particles 1M, 12M and 13M

The colorant dispersion for the Toner particle 11M was prepared by following way. Quinoline solvent 140 parts by weight was dispersed by a DISPER and a mixture of the dispersed solvent and 2 weight by parts of wet paste of C.I. Pigment Red 122 (content ratio of the colorant 37 weight by parts) was placed into a vessel which can be undergone vacuum evaporation. The mixture was heated at from 100 to 120° C. with reducing pressure to not more than 50 Torr by an aspirator so that water contained in the vessel was removed by evaporation as little as possible and the temperature was controlled at 120° C. Then 2 parts by weight of sulfonation agent chlorosulfuric acid was added, and reaction was made for 5 hours with stirring, and after the completion of the reaction, the surface treated C.I. Pigment Red 122 was washed several times with solvent in excess amount, was poured into water, and wet colorant paste of surface treated C.I. Pigment Red 122, containing 31% colorant by weight, was obtained by filtration. The wet colorant paste of C.I. Pigment Red 122, containing 31% colorant by weight, in an amount of 3.87 kg was gradually added into a solution obtained by stirring 10.0 L of deionized water and 0.90 kg of sodium n-dodecylsulfate, and they were subjected to dispersion process for 60 minutes continuously by CLEARMIX shown by FIG. 3(*b*) after stirring well for one hour. Thus the colorant dispersion for the Toner particle 11M.

The colorant dispersion for the Toner particle 12M was prepared by following way. Into 10.0 L of deionized water 0.90 kg of sodium n-dodecylsulfate was added and stirred. Into the solution 1.64 kg of wet colorant paste of C.I. Pigment Red 122, containing 73% colorant by weight, which was not surface treated, was added gradually and stirred well for one hour, then the mixture was dispersed for 60 minutes continuously by CLEARMIX shown by FIG. 3(*b*). Thus the colorant dispersion for the Toner particle 12M was obtained.

The colorant dispersion for the Toner particle 13M was prepared by following way. Into 10.0 L of deionized water 0.90 kg of sodium n-dodecylsulfate was added and stirred. Into the solution 8.00 kg of wet colorant paste of C.I. Pigment Red 122, containing 15% colorant by weight, which was not surface treated, was added gradually and stirred well for one hour, then the mixture was dispersed for 45 minutes continuously by CLEARMIX shown by FIG. 3(*b*). Thus the colorant dispersion for the Toner particle 13M was obtained.

Preparation Example of Toner Particles 1C Through 9C and Comparative Toner Particles 1C, 2C and 4C Added to 1600 ml of deionized water were 90 g of anionic surfactant (101) which were stirred and dissolved. While stirring the resulting solution, 400 g of pigment, (C.I. Pigment Blue 15:3), were gradually added, and subsequently dispersed employing a stirring unit, "Clearmix" (produced by M Technique Ltd.). Thus a colorant particle dispersion (hereinafter referred to as "Colorant Dispersion (C)") was prepared. The colorant particle diameter of said Colorant Dispersion (C) was determined employing an electrophoresis light scattering photometer "ELS-800" (produced by Ohtsuka Denshi Co.), resulting in a weight average particle diameter measurement of 250 nm.

Toner particles were obtained by the same way as the Toner particles 1Bk through 9Bk and the Comparative toner particles 1Bk, 2Bk and 4Bk except that 168 g of Colorant Dispersion (C) was employed in place of 200 g of Colorant Dispersion (Bk). The toner particles thus obtained were designated as Toner particles 1C through 9C and Comparative toner particles 1C, 2C and 4C.

Preparation of Toner Particle 10C and Comparative Toner Particle 3C

Toner particle 10C and Comparative toner particle 3C were prepared in the same way as the Toner particles 1C through 9C and the Comparative toner particles 1C, 2C and 4C except that the latex 2L was not added.

Preparation of Toner Particles 11C, 12C and 13C

The colorant dispersion for the Toner particle 11C was prepared by following way. Dimethylacetoamide 120 parts by weight was dispersed by a DISPER and a mixture of the dispersed solvent and 2 weight by parts of wet paste of C.I. Pigment Blue 15:3 (content ratio of the colorant 35 weight by parts) was placed into a vessel which can be undergone vacuum evaporation. The mixture was heated at from 100 to 120° C. with reducing pressure to not more than 50 Torr by an aspirator so that water contained in the vessel was removed by evaporation as little as possible and the temperature was controlled at 120° C. Then 2 parts by weight of sulfonation agent chlorosulfuric acid was added, and reaction was made for 5 hours with stirring, and after the completion of the reaction, the surface treated C.I. Pigment Blue 15:3 was washed several times with solvent in excess amount, was poured into water, and wet colorant paste of surface treated C.I. Pigment Blue 15:3, containing 31% colorant by weight, was obtained by filtration. The wet colorant paste of C.I. Pigment Blue 15:3, containing 31% colorant by weight, in an amount of 1.94 kg was gradually added into a solution obtained by stirring 10.0 L of deionized water and 0.90 kg of sodium n-dodecylsulfate, and they were subjected to dispersion process for 60 minutes continuously by CLEARMIX shown by FIG. 3(*b*) after stirring well for one hour. Thus the colorant dispersion for the Toner particle 11C.

The colorant dispersion for the Toner particle 12C was prepared by following way. Into 10.0 L of deionized water 0.90 kg of sodium n-dodecylsulfate was added and stirred. Into the solution 0.82 kg of wet colorant paste of C.I. Pigment Blue 15:3, containing 73% colorant by weight, which was not surface treated, was added gradually and stirred well for one hour, then the mixture was dispersed for 60 minutes continuously by CLEARMIX shown by FIG. 3(*b*). Thus the colorant dispersion for the Toner particle 12C was obtained.

The colorant dispersion for the Toner particle 13C was prepared by following way. Into 10.0 L of deionized water 0.90 kg of sodium n-dodecylsulfate was added and stirred. Into the solution 4.00 kg of wet colorant paste of C.I. Pigment Blue 15:3, containing 15% colorant by weight, which was not surface treated, was added gradually and stirred well for one hour, then the mixture was dispersed for 45 minutes continuously by CLEARMIX shown by FIG. 3(*b*). Thus the colorant dispersion for the Toner particle 13C was obtained.

The result of the obtained toner such as number average particle diameter, variation coefficient of the number distribution and so on is shown in Table 1, and the result of the dispersion state of the colorant and so on is shown in Table 2.

TABLE 1

| Colorant particle No. | Number average particle diameter (μm) | Ratio of toner particles having shape coefficient of 1.2 to 1.6 | Variation coefficient of shape coefficient | Ratio of particles having no corner | Variation coefficient of number distribution | M (sum of m1 and m2) |
|---|---|---|---|---|---|---|
| Colorant particle 1 Bk | 4.2 | 65.8 | 15.8 | 61 | 24.2 | 70.1 |
| Colorant particle 2 Bk | 5.1 | 65.1 | 15.2 | 48 | 26.4 | 72.3 |
| Colorant particle 3 Bk | 5.2 | 59.1 | 15.4 | 52 | 25.8 | 75.7 |
| Colorant particle 4 Bk | 6.2 | 58.1 | 15.1 | 46 | 22.4 | 54.2 |
| Colorant particle 5 Bk | 5.8 | 60.6 | 16.5 | 55 | 26.7 | 64.5 |
| Colorant particle 6 Bk | 6.5 | 67.8 | 14.8 | 44 | 30.1 | 61.6 |
| Colorant particle 7 Bk | 7.6 | 42.8 | 30.5 | 39 | 32.5 | 51.4 |
| Colorant particle 8 Bk | 5.2 | 67.1 | 14.2 | 59 | 26.2 | 75.5 |
| Colorant particle 9 Bk | 5.7 | 65.7 | 15.4 | 58 | 25.4 | 72.6 |
| Colorant particle 10 Bk | 6.2 | 68.4 | 15.8 | 55 | 25.8 | 72.1 |
| Comparative Colorant particle 1 Bk | 5.7 | 71.2 | 15.7 | 51 | 25.1 | 72.6 |
| Comparative Colorant particle 2 Bk | 5.4 | 67.5 | 14.5 | 53 | 24.1 | 71.2 |
| Comparative Colorant particle 3 Bk | 4.7 | 66.4 | 14.9 | 52 | 26.2 | 75.0 |
| Comparative Colorant particle 4 Bk | 5.8 | 64.1 | 15.4 | 53 | 26.7 | 72.1 |
| Colorant particle 1 Y | 4.2 | 65.8 | 15.8 | 61 | 24.2 | 70.1 |
| Colorant particle 2 Y | 5.1 | 65.1 | 15.2 | 48 | 26.4 | 72.3 |
| Colorant particle 3 Y | 5.2 | 59.1 | 15.4 | 52 | 25.8 | 75.7 |
| Colorant particle 4 Y | 6.2 | 58.1 | 15.1 | 46 | 22.4 | 54.2 |
| Colorant particle 5 Y | 5.8 | 60.6 | 16.5 | 55 | 26.7 | 64.5 |
| Colorant particle 6 Y | 6.5 | 67.8 | 14.8 | 44 | 30.1 | 61.6 |
| Colorant particle 7 Y | 7.6 | 42.8 | 30.5 | 39 | 32.5 | 51.4 |
| Colorant particle 8 Y | 5.2 | 67.1 | 14.2 | 59 | 26.2 | 75.5 |
| Colorant particle 9 Y | 5.7 | 65.7 | 15.4 | 58 | 25.4 | 72.6 |
| Colorant particle 10 Y | 6.2 | 68.4 | 15.8 | 55 | 25.8 | 72.1 |
| Colorant particle 11 Y | 4.6 | 69.5 | 15.2 | 72 | 24.4 | 72.1 |
| Colorant particle 12 Y | 6.1 | 65.8 | 15.7 | 69 | 25.5 | 71.2 |
| Colorant particle 13 Y | 5.7 | 66.3 | 15.4 | 63 | 26.5 | 73.6 |
| Comparative Colorant particle 1 Y | 5.7 | 71.2 | 15.7 | 51 | 25.1 | 72.6 |
| Comparative Colorant particle 2 Y | 5.4 | 67.5 | 14.5 | 53 | 24.1 | 71.2 |

TABLE 1-continued

| Colorant particle No. | Number average particle diameter (μm) | Ratio of toner particles having shape coefficient of 1.2 to 1.6 | Variation coefficient of shape coefficient | Ratio of particles having no corner | Variation coefficient of number distribution | M (sum of m1 and m2) |
|---|---|---|---|---|---|---|
| Comparative Colorant particle 3 Y | 4.7 | 66.4 | 14.9 | 52 | 26.2 | 75.0 |
| Comparative Colorant particle 4 Y | 5.8 | 64.1 | 15.4 | 53 | 26.7 | 72.1 |
| Colorant particle 1 M | 4.2 | 65.8 | 15.8 | 61 | 24.2 | 70.1 |
| Colorant particle 2 M | 5.1 | 65.1 | 15.2 | 48 | 26.4 | 72.3 |
| Colorant particle 3 M | 5.2 | 59.1 | 15.4 | 52 | 25.8 | 75.7 |
| Colorant particle 4 M | 6.2 | 58.1 | 15.1 | 48 | 22.4 | 54.2 |
| Colorant particle 5 M | 5.8 | 60.6 | 16.5 | 55 | 26.7 | 64.5 |
| Colorant particle 6 M | 6.5 | 67.8 | 14.8 | 44 | 30.1 | 61.6 |
| Colorant particle 7 M | 7.6 | 42.8 | 30.5 | 39 | 32.5 | 51.4 |
| Colorant particle 8 M | 5.2 | 87.1 | 14.2 | 59 | 26.2 | 75.5 |
| Colorant particle 9 M | 5.7 | 65.7 | 15.4 | 58 | 25.4 | 72.6 |
| Colorant particle 10 M | 6.2 | 68.4 | 15.8 | 55 | 25.8 | 72.1 |
| Colorant particle 11 M | 4.7 | 68.6 | 14.9 | 77 | 25.9 | 78.4 |
| Colorant particle 12 M | 5.8 | 66.6 | 15.7 | 68 | 26.0 | 70.4 |
| Colorant particle 13 M | 5.7 | 63.5 | 15.8 | 64 | 26.5 | 72.6 |
| Comparative Colorant particle 1 M | 5.7 | 71.2 | 15.7 | 51 | 25.1 | 72.6 |
| Comparative Colorant particle 2 M | 5.4 | 67.5 | 14.5 | 53 | 24.1 | 71.2 |
| Comparative Colorant particle 3 M | 4.7 | 66.4 | 14.9 | 52 | 26.2 | 75.0 |
| Comparative Colorant particle 4 M | 5.8 | 64.1 | 15.4 | 53 | 26.7 | 72.1 |
| Colorant particle 1 C | 4.2 | 65.8 | 15.8 | 61 | 24.2 | 70.1 |
| Colorant particle 2 C | 5.1 | 65.1 | 15.2 | 48 | 26.4 | 72.3 |
| Colorant particle 3 C | 5.2 | 59.1 | 15.4 | 52 | 25.8 | 75.7 |
| Colorant particle 4 C | 6.2 | 58.1 | 15.1 | 46 | 22.4 | 54.2 |
| Colorant particle 5 C | 5.8 | 60.6 | 16.5 | 55 | 26.7 | 64.5 |
| Colorant particle 6 C | 6.5 | 67.8 | 14.8 | 44 | 30.1 | 61.6 |
| Colorant particle 7 C | 7.6 | 42.8 | 30.5 | 39 | 32.5 | 51.4 |
| Colorant particle 8 C | 5.2 | 67.1 | 14.2 | 59 | 26.2 | 75.5 |
| Colorant particle 9 C | 5.7 | 65.7 | 15.4 | 58 | 25.4 | 72.6 |
| Colorant particle 10 C | 6.2 | 68.4 | 15.8 | 55 | 25.8 | 72.1 |
| Colorant particle 11 C | 4.5 | 69.8 | 14.8 | 74 | 24.2 | 73.5 |
| Colorant particle 12 C | 5.8 | 65.9 | 15.7 | 67 | 26.1 | 71.3 |
| Colorant particle 13 C | 5.7 | 60.8 | 15.9 | 62 | 26.6 | 72.2 |
| Comparative Colorant particle 1 C | 5.7 | 71.2 | 15.7 | 51 | 25.1 | 72.6 |

TABLE 1-continued

| Colorant particle No. | Number average particle diameter (μm) | Ratio of toner particles having shape coefficient of 1.2 to 1.6 | Variation coefficient of shape coefficient | Ratio of particles having no corner | Variation coefficient of number distribution | M (sum of m1 and m2) |
|---|---|---|---|---|---|---|
| Comparative Colorant particle 2 C | 5.4 | 67.5 | 14.5 | 53 | 24.1 | 71.2 |
| Comparative Colorant particle 3 C | 4.7 | 66.4 | 14.9 | 52 | 26.2 | 75.0 |
| Comparative Colorant particle 4 C | 5.8 | 64.1 | 15.4 | 53 | 26.7 | 72.1 |

TABLE 2

| Colorant particle No. | Average area of Voronoi polygon | Variation coefficient of area of Voronoi polygon | Percentage of toner particles having Voronoi polygon area of 1600 $nm^2$ | Average area of Voronoi polygon inside 1 μm radius circle | Average area of Voronoi polygon outside 1 μm radius circle | The number of the domains having of Voronoi polygon area at least 160,000 $nm^2$ contact with the external circumference | Area having no domain contact with the external circum-ference |
|---|---|---|---|---|---|---|---|
| Colorant Particle 1 Bk | 84200 | 10.5 | 7.2 | 76700 | 98500 | 11 | Observed |
| Colorant Particle 2 Bk | 76500 | 19.5 | 3.5 | 66500 | 79600 | 13 | Observed |
| Colorant particle 3 Bk | 66400 | 14.1 | 6.1 | 62500 | 68800 | 14 | Observed |
| Colorant particle 4 Bk | 96200 | 18.2 | 7.2 | 86400 | 99600 | 24 | Observed |
| Colorant particle 5 Bk | 77400 | 9.9 | 14.6 | 71500 | 79400 | 27 | Observed |
| Colorant particle 6 Bk | 46500 | 15.6 | 12.5 | 42600 | 48800 | 16 | Observed |
| Colorant particle 7 Bk | 86800 | 10.6 | 17.3 | 81200 | 87900 | 17 | Observed |
| Colorant particle 8 Bk | 116600 | 23.9 | 18.3 | 108000 | 119000 | 28 | Observed |
| Colorant particle 9 Bk | 27500 | 7.7 | 3.6 | 21200 | 35400 | 6 | Observed |
| Colorant particle 10 Bk | 96400 | 18.1 | 2.5 | 97600 | 92200 | 2 | Not observed |
| Comparative Colorant particle 1 Bk | 439000 | 31.2 | 32.1 | 432000 | 458300 | 51 | Not observed |
| Comparative Colorant particle 2 Bk | 127600 | 31.9 | 22.6 | 127700 | 127600 | 34 | Not observed |
| Comparative Colorant particle 3 Bk | 132100 | 24.6 | 0.9 | 73100 | 74900 | 1 | Not observed |
| Comparative Colorant particle 4 Bk | 105600 | 37.5 | 19.2 | 104600 | 115200 | 17 | Not observed |
| Colorant particle 1 Y | 85940 | 10.3 | 7.5 | 82100 | 88500 | 12 | Observed |
| Colorant particle 2 Y | 75880 | 18.1 | 3.2 | 71200 | 79000 | 14 | Observed |
| Colorant particle 3 Y | 66580 | 11.5 | 6.6 | 63400 | 68700 | 15 | Observed |
| Colorant particle 4 Y | 94020 | 16.4 | 6.9 | 86400 | 99100 | 22 | Observed |
| Colorant particle 5 Y | 76480 | 8.4 | 15.2 | 72400 | 79200 | 25 | Observed |
| Colorant particle 6 Y | 45960 | 12.6 | 13.4 | 44100 | 47200 | 15 | Observed |
| Colorant particle 7 Y | 84660 | 10.6 | 15.5 | 79500 | 88100 | 16 | Observed |
| Colorant partic1e 8 Y | 116440 | 24.1 | 17.4 | 112000 | 119400 | 27 | Observed |
| Colorant particle 9 Y | 29320 | 6.6 | 3.4 | 21400 | 34600 | 7 | Observed |

TABLE 2-continued

| Colorant particle No. | Average area of Voronoi polygon | Variation coefficient of area of Voronoi polygon | Percentage of toner particles having Voronoi polygon area of 1600 $nm^2$ | Average area of Voronoi polygon inside 1 $\mu m$ radius circle | Average area of Voronoi polygon outside 1 $\mu m$ radius circle | The number of the domains having of Voronoi polygon area at least 160,000 $nm^2$ contact with the external circumference | Area having no domain contact with the external circum-ference |
|---|---|---|---|---|---|---|---|
| Colorant particle 10 Y | 93800 | 16.6 | 2.4 | 97700 | 91200 | 4 | Not observed |
| Colorant particle 11 Y | 62820 | 6.8 | 4.1 | 66240 | 64810 | 6 | Observed |
| Colorant particle 12 Y | 84570 | 15.6 | 6.2 | 82210 | 88760 | 8 | Observed |
| Colorant particle 13 Y | 48280 | 6.2 | 5.6 | 44160 | 49770 | 7 | Observed |
| Comparative Colorant particle 1 Y | 442100 | 25.4 | 34.5 | 43200 | 448900 | 54 | Not observed |
| Comparative Colorant particle 2 Y | 126100 | 31.2 | 24.4 | 128500 | 124500 | 33 | Not observed |
| Comparative Colorant particle 3 Y | 132000 | 22.4 | 1.1 | 130200 | 133200 | 0 | Not observed |
| Comparative Colorant particle 4 Y | 106800 | 34.5 | 19.4 | 102400 | 109800 | 16 | Not observed |
| Colorant particle 1 M | 82900 | 10.5 | 5.2 | 74600 | 88400 | 13 | Observed |
| Colorant particle 2 M | 74700 | 19.5 | 1.5 | 68900 | 78600 | 15 | Observed |
| Colorant particle 3 M | 66900 | 14.1 | 4.1 | 66100 | 67500 | 16 | Observed |
| Colorant particle 4 M | 94700 | 18.2 | 5.2 | 89100 | 98500 | 26 | Observed |
| Colorant particle 5 M | 76200 | 9.9 | 12.6 | 72100 | 78900 | 29 | Observed |
| Colorant particle 6 M | 45900 | 15.6 | 10.5 | 44100 | 47100 | 18 | Observed |
| Colorant particle 7 M | 86700 | 10.6 | 15.3 | 84600 | 88100 | 19 | Observed |
| Colorant particle 8 M | 116500 | 23.9 | 16.3 | 112100 | 119500 | 30 | Observed |
| Colorant particle 9 M | 28500 | 7.7 | 1.6 | 22400 | 32500 | 8 | Observed |
| Colorant particle 10 M | 95300 | 18.1 | 0.5 | 96600 | 94500 | 4 | Not observed |
| Colorant particle 11 M | 78410 | 6.9 | 4.6 | 76610 | 80070 | 5 | Observed |
| Colorant particle 12 M | 88710 | 17.4 | 5.8 | 87260 | 89860 | 7 | Observed |
| Colorant particle 13 M | 49960 | 6.8 | 5.2 | 47140 | 50160 | 9 | Observed |
| Comparative Colorant particle 1 M | 435900 | 31.2 | 30.1 | 422100 | 445100 | 53 | Not observed |
| Comparative Colorant particle 2 M | 126200 | 31.9 | 20.6 | 129400 | 126800 | 36 | Not observed |
| Comparative Colorant particle 3 M | 132400 | 24.5 | 2.5 | 129200 | 134500 | 1 | Not observed |
| Comparative Colorant particle 4 M | 108700 | 37.5 | 17.2 | 98700 | 115400 | 19 | Not observed |
| Colorant particle 1 C | 86260 | 11.6 | 8.8 | 82600 | 88700 | 14 | Observed |
| Colorant particle 2 C | 76960 | 19.4 | 4.5 | 71700 | 78800 | 16 | Observed |
| Colorant particle 3 C | 66660 | 12.8 | 7.9 | 63900 | 68500 | 17 | Observed |
| Colorant particle 4 C | 94060 | 17.7 | 8.2 | 86200 | 99300 | 24 | Observed |
| Colorant particle 5 C | 76560 | 9.7 | 16.5 | 72900 | 79000 | 27 | Observed |
| Colorant particle 6 C | 46040 | 13.9 | 14.7 | 44600 | 47000 | 17 | Observed |

TABLE 2-continued

| Colorant particle No. | Average area of Voronoi polygon | Variation coefficient of area of Voronoi polygon | Percentage of toner particles having Voronoi polygon area of 1600 $nm^2$ | Average area of Voronoi polygon inside 1 $\mu m$ radius circle | Average area of Voronoi polygon outside 1 $\mu m$ radius circle | The number of the domains having of Voronoi polygon area at least 160,000 $nm^2$ contact with the external circumference | Area having no domain contact with the external circumference |
|---|---|---|---|---|---|---|---|
| Colorant particle 7 C | 86160 | 11.9 | 16.8 | 80000 | 88600 | 18 | Observed |
| Colorant particle 8 C | 116240 | 25.4 | 18.7 | 111800 | 119200 | 29 | Observed |
| Colorant particle 9 C | 29640 | 7.9 | 4.7 | 21900 | 34800 | 9 | Observed |
| Colorant particle 10 C | 93880 | 17.1 | 3.7 | 98200 | 91000 | 6 | Not observed |
| Colorant particle 11 C | 66740 | 7.1 | 4.6 | 64640 | 69960 | 6 | Observed |
| Colorant particle 12 C | 81220 | 14.8 | 6.7 | 80100 | 82790 | 8 | Observed |
| Colorant particle 13 C | 46750 | 7.2 | 5.8 | 45660 | 49820 | 8 | Observed |
| Comparative Colorant particle 1 C | 442180 | 32.4 | 35.8 | 431800 | 449100 | 55 | Not observed |
| Comparative Colorant particle 2 C | 122900 | 33.6 | 25.7 | 128300 | 121400 | 35 | Not observed |
| Comparative Colorant particle 3 C | 132040 | 24.1 | 2.4 | 130000 | 133400 | 2 | Not observed |
| Comparative Colorant particle 4 C | 106640 | 35.4 | 20.7 | 102200 | 109800 | 18 | Not observed |

To each of the obtained Toner particles 1Y through 13Y, Comparative toner particles 1Y through 4Y, Toner particles 1M through 13M, Comparative toner particles 1M through 4M, Toner particles 1C through 13C, and Comparative toner particles 1C through 4C, 1.0% by weight of hydrophobic silica, having number average primary particle diameter 10 nm and hydrophobicity of 63, and 1.2% by weight of hydrophobic titanium oxide, having number average primary particle diameter 25 nm and hydrophobicity of 60 were respectively added and blended by Henschel mixer and the toners were obtained.

Particle diameter and shape of the toner particles were not varied by addition of the hydrophobic silica and hydrophobic titanium oxide. The obtained toners were designated to Toners 1Bk through 13Bk, Comparative toner 1Bk through 4Bk, Toners 1Y through 13Y, Comparative toners 1Y through 4Y, Toners 1M through 13M, Comparative toners 1M through 4M, Toners 1C through 13C, and Comparative toners 1C through 4C, corresponding to the toner particles.

Preparation of Carrier

Preparation of Ferrite Core Material

By a wet type ball mill 18 mol % of MnO, 4 mol % of MgO and 78 mol % of $Fe_2O_3$ were pulverized, blended for 2 hours, and then dried, preliminary burned at 900° C. for 2 hours, and were made to slurry by pulverizing for 3 hours by a ball mill. A dispersing agent and a binder were added, and they were granulated and dried by a spray drier, and subjected to burning at 1200° C. for 3 hours, to obtain ferrite core material having specific resistivity of 4.3×10 Ωcm.

Preparation of Coating Resin

Initially, a cyclohexyl methacrylate/methyl methacrylate (at a copolymerization ratio of 5/5) copolymer was synthesized employing an emulsion polymerization method in which the concentration in an aqueous solution medium employing sodium benzenesulfonate having an alkyl group having 12 carbon atoms as a surface active agent, and fine resinous particles were obtained having a volume average primary particle diameter of 0.1 $\mu m$, a weight average molecular weight (Mw) of 200,000, a number average molecular weight (Mn) of 91,000, an Mw/Mn of 2.2, a softening temperature (Tsp) of 230° C., and a glass transition temperature (Tg) of 110° C. Incidentally, said fine resinous particles were treated to be azeotropic with water and the residual monomer amount was adjusted to 510 ppm.

Subsequently, charged into a high-speed mixer employing stirring blades were 100 parts by weight of ferrite core material particles and 2 parts by weight of said fine resinous particles, and the resulting mixture was blended at 120° C. for 30 minutes, and utilizing mechanical impact force action, a resin coated carrier having a volume average particle diameter of 39 $\mu m$ was prepared.

Production of Developer

Each type of colored particles added with external additives was blended with said carrier, and a developer, having a toner concentration of 6 percent by weight, was prepared. The obtained toners were designated to Developers 1Bk through 13Bk, Comparative Developers 1Bk through 4Bk, Developers 1Y through 13Y, Comparative Developers 1Y through 4Y, Developers 1M through 13M, Comparative Developers 1M through 4M, Developers 1C through 13C, and Comparative Developers 1C through 4C, corresponding to the toner.

Examples 1–13 and Comparative Examples 1–4

The above mentioned black, yellow, magenta and cyan toners were combined for the Examples 1–13 and Comparative Examples 1–4. The black coupler combined with the developers 11Y, 11M, 11C, developers 12Y, 12M, 12C, and developers 13Y, 13M, 13C was Developer 1Bk.

Actual copying test was conducted for each of the Developers 1-13 and Comparative Developer 1-4 having the combination mentioned above employing a modified intermediate transfer type color copying machine 7823 manufactured by Konica Corporation, and evaluation test was conducted for the items shown below under the high temperature and normal humidity (33° C. and 80% RH). A photoreceptor drum having multi-layer organic photoreceptor was employed.

A full-color image (having a pixel ratio of 15 percent for each yellow, magenta, cyan and black image) was continually printed out for 5,000 sheets, and the evaluation shown below was made. Further after leaving 72 hours the same evaluation was conducted. The evaluation items were shown below.

Thus obtained images were evaluated with respect to the density of a 10% dot image, the line width, the character clogging, the fine dot scattering, the color difference and the fogging. Evaluation of secondary color of the color toners, that is, multi-color image formed by the image forming apparatus, were conducted for the images formed by a combination of toners. Actually monotone image of red formed by a combination of yellow and magenta toner, green by a combination of yellow and cyan toners and blue by a combination of cyan and magenta toners were formed and evaluated. The evaluation of fogging was conducted for image forming of 100,000 sheets as a whole.

(1) Density of 10% Dot Image

The relative reflective density of a 10% dot image having an area of 20 mm×20 mm was measured by a reflective densitometer Macbeth RD-918. The reflective density of the white background of the image was used as the reference of the relative reflective density. The of the 10% dot image density was measured for evaluating the reproducibility of dot and that of the halftone image. When the density variation is less than 0.10, the variation of the image quality is a small and it may be concluded that there is no problem.

(2) Line Width

The width of line image corresponding to a two dots line signal was measured by a character evaluation system RT2000 manufactured by Yaman Co., Ltd. When the line width of the firstly printed image and that of the 20,000$^{th}$ printed image are not more than 200 $\mu$m and the variation of the line width is less than 10 $\mu$m, there is no problem on the reproducibility of the fine line.

(3) Character Clogging

Images of 3-point and 5-point characters were formed and evaluated according to the following norms.

A: Both of the images of the 3-point and-5 point characters are clear and legible.

B: A part of the images of the 3-point characters were illegible but the images of the 5-point characters are clear and legible.

C: Almost images of the 3-point characters are illegible and all of apart of the images of the 5-point characters were illegible.

(4) Scattering of Fine Dot

A uniform 10% dot image of secondary colors, red, blue and green, and the scattering around the dots were observed by a magnifying glass and evaluated according to the following norms.

A: The scattering is almost not observed.

B: The scattering is observed a little but cannot be detected without careful observation.

C: The scattering is easily observed.

(5) Color Difference

The colors of solid images of the secondary colors, red, blue and green, formed on the first and 20000th prints were measured by Macbeth Color-Eye 7000. The color difference was calculated by CMC (2:1) color difference equation. When the color difference determined by the CMC (2:1) color difference equation is less than 5, the variation of the color of the formed image is acceptable.

(6) Transparency of OHP Image

Transparent image was formed on an OHP sheet and was evaluated in the following way. Evaluation was made for a toner content on a sheet within the range of 0.7 plus minus 0.05 mg/cm$^2$. The spectral transmittance of the fixed image formed on an OHP sheet was measured with an OHP sheet having no toner image as a reference by employing 330 Automatic Recording spectroscopic analyzer (product of HITACHI Corporation), and difference of spectral transmittance between 650 and 450 nm for a yellow toner, difference of spectral transmittance between 650 and 550 nm for a magenta toner, and difference of spectral transmittance between 500 and 600 nm for a magenta toner were measured and transparency was evaluated. It is classified good transparency in case that the value is not less than 70%. The transparency was evaluated for the toner giving largest difference of the spectral transmittance among yellow, magenta and cyan toners.

A: 90% or more

B: 70% to not more than 90%

C: Not more than 70%

(6) Occurrence of Fogging

The printing of a full color image having a pixel ratio of Y/M/C/Bk of each 15% was performed continuously for 1,000 times under a condition of high temperature of 33° C. and a high humidity of a relative humidity of 80%, and then the switch was off to rest the apparatus for 2 hours. The printing according to such the mode was repeated for 100 times until 100,000 sheets in total of prints were obtained. Thus obtained prints were successively observed and the number of prints until occurrence of the contamination of the image or fogging was counted.

TABLE 3

| | 10% dot density | | Line width ($\mu$m) | | Character clogging | | Fine dot scattering | | Color difference | | OHP Transparency | | |
|---|---|---|---|---|---|---|---|---|---|---|---|---|---|
| | After 5000 sheets copying | After 72 hours leaving | After 5000 sheets copying | After 72 hours leaving | After 5000 sheets copying | After 72 hours leaving | After 5000 sheets copying | After 72 hours leaving | After 5000 sheets copying | After 72 hours leaving | After 5000 sheets copying | After 72 hours leaving | Fogging |
| Example 1 | 0.09 | 0.11 | 191 | 191 | A | A | A | A | A | B | A | B | Not found |
| Example 2 | 0.09 | 0.12 | 190 | 190 | A | A | A | A | B | B | B | B | Not found |

TABLE 3-continued

| | 10% dot density | | Line width (μm) | | Character clogging | | Fine dot scattering | | Color difference | | OHP Transparency | | |
|---|---|---|---|---|---|---|---|---|---|---|---|---|---|
| | After 5000 sheets copying | After 72 hours leaving | After 5000 sheets copying | After 72 hours leaving | After 5000 sheets copying | After 72 hours leaving | After 5000 sheets copying | After 72 hours leaving | After 5000 sheets copying | After 72 hours leaving | After 5000 sheets copying | After 72 hours leaving | Fogging |
| Example 3 | 0.11 | 0.13 | 191 | 192 | A | A | A | A | A | B | A | B | Not found |
| Example 4 | 0.12 | 0.15 | 190 | 193 | A | B | A | B | B | B | A | B | Not found |
| Example 5 | 0.14 | 0.17 | 191 | 195 | A | B | A | B | A | B | A | B | Not found |
| Example 6 | 0.15 | 0.18 | 192 | 196 | A | B | A | B | A | B | A | B | Not found |
| Example 7 | 0.15 | 0.19 | 193 | 196 | A | B | A | B | B | B | A | B | 99900 |
| Example 8 | 0.13 | 0.15 | 194 | 196 | A | B | A | B | B | B | B | B | 99500 |
| Example 9 | 0.14 | 0.17 | 194 | 197 | A | B | A | B | A | B | B | B | 99700 |
| Example 10 | 0.12 | 0.15 | 195 | 198 | A | B | A | B | A | B | B | B | 92000 |
| Example 11 | 0.10 | 0.11 | 192 | 192 | A | A | A | A | A | A | A | A | Not found |
| Example 12 | 0.12 | 0.12 | 191 | 192 | A | A | A | A | A | A | A | A | Not found |
| Example 13 | 0.11 | 0.12 | 190 | 192 | A | A | A | A | A | A | A | A | Not found |
| Comparative 1 | 0.12 | 0.36 | 187 | 211 | C | C | C | C | C | C | C | C | 8050 |
| Comparative 2 | 0.12 | 0.36 | 187 | 211 | C | C | C | C | C | C | C | C | 3800 |
| Comparative 3 | 0.12 | 0.22 | 187 | 211 | B | C | B | C | B | C | C | C | 2450 |
| Comparative 4 | 0.12 | 0.26 | 187 | 211 | B | C | B | C | C | C | C | C | 7000 |

It is apparently confirmed by the above Examples that, by employing the Toners 1 through 13, images without fluctuation of half tone density were obtained employed in a circumstances of high temperature and high humidity, or after leaving 72 hours, multi-color images are not affected by the colorant contained in the developers under the circumstances mentioned above, and particularly multi-color images having good color difference were obtained constantly, and further, high quality images excellent in developability and fine line reproduction were formed stably for long term. Such effects obtained by inventive toners were not obtained by the Comparative developers under the same circumstances to the contrary.

It is apparent from the result of the Example that it has been found variation of charge quantity is depressed under the circumstances of high temperature and high humidity, or generation of uneven density of half tone image formed after leaving for long time is avoided regardless the affect of the remaining material on the surface of the toner particle by specify the dispersion state and occupation state of the domain part of the toner according to the invention, which has domain-matrix construction in toner particles.

Further, it is found that, by employing the toner according to the invention, multi-color images having excellent transparency, good color difference, and it enables to form a high quality image with excellent developability and fine lie reproduction stably for long term, particularly toner which can be applied for forming digital multi-color image is obtained.

What is claimed is:

1. An electrostatic image developing toner comprising a coloring agent and toner particles, said toner particles have a matrix-domain structure in which the domain consists of a colorant particle, and the average of the area of a Voronoi polygon formed by the perpendicular bisecting line between the centers of gravity of domains adjacent to each other in said matrix-domain structure is from 20,000 to 120,000 $nm^2$, and the variation coefficient of the area of said Voronoi polygon is less than or equal to 25 percent.

2. The electrostatic image developing toner of claim 1, wherein the average of the area of said Voronoi polygon formed by the perpendicular bisecting line between the centers of gravity of domains adjacent to each other in said matrix-domain structure is from 40,000 to 100,000 $nm^2$, and the variation coefficient of the area of said Voronoi polygon is less than or equal to 20 percent.

3. The electrostatic image developing toner of claim 1, wherein the average of the area of said Voronoi polygon formed by the perpendicular bisecting line between the centers of gravity of domains adjacent to each other in said matrix-domain structure is from 20,000 to 120,000 $nm^2$, and the number ratio of the domain, which forms said Voronoi polygon having an area of at least 160,000 $nm^2$, is from 3 to 20 percent of the total number of domains.

4. The electrostatic image developing toner of claim 1, wherein the average of the area of a Voronoi polygon formed by the perpendicular bisecting line between the centers of gravity of the domains in the exterior of a 1,000 nm radius circle having the center of gravity in the cross-section of said toner particle as the center is smaller than the average of the area of a Voronoi polygon formed by the perpendicular bisecting line between the centers of gravity of said domain in the interior of said circle.

5. The electrostatic image developing toner of claim 1, wherein of Voronoi polygons formed by the perpendicular bisecting line between the centers of gravity of the domains adjacent to each other in said matrix-domain structure, the number ratio of Voronoi polygons having an area of at least 160,000 $nm^2$, which come into contact with the external circumference of said toner is from 3 to 20 percent of the total number of said domains.

6. The electrostatic image developing toner of claim 1, wherein said toner particle is comprised of a matrix-domain structure and has a region comprising no domain portion of a length of 500 to 6,000 nm as well as a height of 100 to 200 nm along the circumference of the cross-section of said toner particle.

7. The electrostatic image developing toner of claim 1, wherein said domains are comprised of ones having different luminance.

8. The electrostatic image developing toner of claim 1, wherein said resin forms the portion corresponding to said matrix, and said coloring agent forms the portion corresponding to said domain.

9. The electrostatic image developing toner of claim 1, wherein said coloring agent is prepared employing a water-dampened coloring agent paste.

10. The electrostatic image developing toner of claim 1, wherein said toner has a number variation coefficient of less than or equal to 27 percent in the number particle size distribution, and also has a variation coefficient of the shape factor is less than or equal to 16 percent.

11. The electrostatic image developing toner of claim 1, wherein said toner is comprised of toner particles without corners of at least 50 percent by number, and has a number variation coefficient in the number particle size distribution of less than or equal to 27 percent.

12. The electrostatic image developing toner of claim 1, wherein said toner is comprised of toner particles having a shape factor of 1.2 to 1.6 of at least 65 percent by number, and has a particle number variation coefficient, in the number particle size distribution, of less than or equal to 27 percent.

13. The electrostatic image developing toner of claim 1, wherein said toner is comprised of toner particles having a number average particle diameter of 3 to 9 $\mu$m.

14. The electrostatic image developing toner of claim 1, wherein said toner has a sum (M) of at least 70 percent, wherein said sum (M) consists of relative frequency (m1) of toner particles which are included in the most frequent class and relative frequency (m2) of toner particles which are included in the second most frequent class in the histogram which shows the particle size distribution based on the number of particles, which is drawn in such a manner that regarding said toner, when the particle diameter of toner particles is represented by D (in $\mu$m), natural logarithm ln D is taken as the abscissa, and said abscissa is divided into a plurality of classes at an interval of 0.23.

15. The electrostatic image developing toner of claim 1, wherein said toner is prepared by salting-out/fusing resinous particles prepared via a process of polymerizing a polymerizable monomer and coloring agent particles.

16. The electrostatic image developing toner of claim 1, wherein said resinous particles are prepared by polymerizing a polymerizable monomer in a water based medium.

17. The electrostatic image developing toner of claim 1, wherein said toner particles are prepared by aggregating and fusing resinous particles and coloring agent particles in a water based medium.

18. The electrostatic image developing toner of claim 1, wherein said toner particles are prepared by salting out/fusing resinous particles prepared by a multi-step polymerization method and coloring agent particles.

19. The electrostatic image developing toner of claim 1, wherein said toner particles are comprised of a resinous layer which is formed by fusing resinous particles comprising a crystalline material, toner particles, and resinous particles comprised of a resin having a lower molecular weight than the resin of said resinous particles, employing a salting-out/fusion method.

* * * * *